US007376236B1

(12) United States Patent
Norris et al.

(10) Patent No.: US 7,376,236 B1
(45) **Date of Patent: *May 20, 2008**

(54) PIEZOELECTRIC FILM SONIC EMITTER

(75) Inventors: Joseph O. Norris, Ramona, CA (US); James J. Croft, III, Poway, CA (US); Alan Robert Selfridge, Los Gatos, CA (US); Pierre Khuri-Yakub, Palo Alto, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/478,114

(22) Filed: Jan. 4, 2000

Related U.S. Application Data

(63) Continuation-in-part of application No. 08/819,614, filed on Mar. 17, 1997, now Pat. No. 6,011,855.

(51) Int. Cl.
*H04R 3/00* (2006.01)

(52) U.S. Cl. ..... 381/111; 381/190

(58) Field of Classification Search ..... 381/111, 381/114, 190, 173; 310/324, 328, 800
See application file for complete search history.

(56) References Cited

U.S. PATENT DOCUMENTS 4,064,375 A 12/1977 Russell et al.
4,284,921 A 8/1981 Lemonon et al.
4,429,193 A 1/1984 Busch-Vishniac
4,439,642 A 3/1984 Reynard
4,558,184 A 12/1985 Busch-Vishniac
4,593,160 A 6/1986 Nakamura
4,672,591 A 6/1987 Breimesser
4,695,986 A 9/1987 Hossack
4,887,246 A 12/1989 Hossack et al.
4,888,086 A 12/1989 Hossack et al.
5,153,859 A 10/1992 Chatigny (Continued)

OTHER PUBLICATIONS

Aoki, K., et al., "Parametric Loudspeaker—Characteristics of Acoustic Field and Suitable Modulation of Carrier Ultrasound," *Electronics and Communications in Japan*, Part 3, vol. 74, No. 9, pp. 76-82 (1991).

(Continued)

*Primary Examiner*—Ping Lee
(74) *Attorney, Agent, or Firm*—Thorpe North & Western LLP

(57) ABSTRACT

A speaker device for emitting subsonic, sonic or ultrasonic compression waves comprising a generally hollow drum, a rigid emitter plate attached to the drum, and a plurality of apertures formed within the plate which are covered by a thin piezoelectric film disposed across the emitter plate. A pressure source is coupled to the drum for developing a biasing pressure with respect to the thin film at the apertures to distend the film into an arcuate emitter configuration capable of constricting and extending in response to variations in the applied electrical input at the piezoelectric film to thereby create a compression wave in a surrounding environment. Parametric ultrasonic frequency input is supplied to the piezoelectric film to propagate multiple ultrasonic frequencies having a difference component corresponding to the desired subsonic, sonic or ultrasonic frequency range.

42 Claims, 18 Drawing Sheets

U.S. PATENT DOCUMENTS

| | | | | |
|---|---|---|---|---|
| 5,287,331 | A | 2/1994 | Shindel | |
| 5,357,578 | A | 10/1994 | Taniishi | |
| 5,700,359 | A | 12/1997 | Bauer | |
| 6,011,855 | A * | 1/2000 | Selfridge et al. | 381/111 |
| 6,044,160 | A * | 3/2000 | Norris | 380/191 |
| 6,925,187 | B2 * | 8/2005 | Norris et al. | 381/191 |
| 2004/0052387 | A1 * | 3/2004 | Norris et al. | 381/190 |
| 2006/0233404 | A1 * | 10/2006 | Croft et al. | 381/191 |

OTHER PUBLICATIONS

Makarov, S.N., et al., "Parametric Acoustic Nondirectional Radiator," *Acustica*, vol. 77, pp. 240-242 (1992).

Westervelt, P.J., Parametric Acoustic Array, "*The Journal of the Acoustical Society of America*," vol. 35, No. 4, pp. 535-537 (1963).

Yoneyama, M., et al., "The Audio Spotlight: An Application of Nonlinear Interaction of Sound Waves to a New Type of Loudspeaker Design," *J. Acoust. Soc. Am.*, vol. 75, No. 5, pp. 1532-1536 (1983).

* cited by examiner

PIEZOELECTRIC FILM SONIC EMITTER

This application is a continuation-in-part of U.S. patent application Ser. No. 08/819,614 filed Mar. 17, 1997 now U.S. Pat. No. 6,011,855.

BACKGROUND OF THE INVENTION

1. Field of the Invention

This invention pertains to compression wave generation. Specifically, the present invention relates to a device and method for directly generating sonic and ultrasonic compression waves, and indirectly generating a new sonic or subsonic compression wave by interaction of two ultrasonic compression waves having frequencies whose difference in value corresponds to the desired new sonic or subsonic compression wave frequencies.

2. State of the Art

Many attempts have been made to reproduce sound in its pure form. In a related patent application under Ser. No. 08/684,311, a detailed background of prior art in speaker technology using conventional speakers having radiating elements was reviewed and is hereby incorporated by reference. A disadvantage with such conventional speakers is distortion arising from the mass of the moving diaphragm or other radiating component. Related problems arise from distortion developed by mismatch of the radiator element across the spectrum of low, medium and high range frequencies—a problem partially solved by the use of combinations of woofers, midrange and tweeter speakers.

Attempts to reproduce audible sound with ultrasonic transducers includes technologies embodied in parametric speakers, acoustic heterodyning, beat frequency interference and other forms of modulation of multiple frequencies to generate a new frequency. In theory, sound is developed by the interaction in air (as a nonlinear medium) of two ultrasonic frequencies whose difference in value falls within the audio range. Ideally, resulting compression waves would be projected within the air as a nonlinear medium, and would be heard as pure sound. Despite using this method, general production of sound for practical applications has eluded the industry for over 100 years. Specifically, a basic parametric or heterodyne speaker has not been developed which can be applied in general applications in a manner such as conventional speaker systems.

A brief history of development of the theoretical parametric speaker array is provided in "Parametric Loudspeaker—Characteristics of Acoustic Field and Suitable Modulation of Carrier Ultrasound", Aoki, Kamadura and Kumamoto, *Electronics and Communications in Japan*. Part 3, Vol. 74, No. 9 (March 1991). Although technical components and the theory of sound generation from a difference signal between two interfering ultrasonic frequencies is described, the practical realization of a commercial sound system was apparently unsuccessful. Note that this weakness in the prior art remains despite the assembly of a parametric speaker array consisting of as many as 1410 piezoelectric transducers yielding a speaker diameter of 42 cm. Virtually all prior research in the field of parametric sound has been based on the use of conventional ultrasonic transducers, typically of bimorf character.

U.S. Pat. No. 5,357,578 issued to Taniishi in October of 1994 introduced alternative solutions to the dilemma of developing a workable parametric speaker system. Hereagain, the proposed device comprises a transducer which radiates the dual ultrasonic frequencies to generate the desired audio difference signal. However, this time the dual-frequency, ultrasonic signal is propagated from a gel medium on the face of the transducer. This medium 20 "serves as a virtual acoustic source that produces the difference tone 23 whose frequency corresponds to the difference between frequencies f1 and f2." Col 4, lines 54-60. In other words, this 1994 reference abandons direct generation of the difference audio signal in air from the face of the transducer, and depends upon the nonlinearity of a gel medium to produce sound. This abrupt shift from transducer/air interface to proposed use of a gel medium reinforces the perception of apparent inoperativeness of prior art disclosures, at least for practical speaker applications.

OBJECTS AND SUMMARY OF THE INVENTION

It is an object of the present invention to provide a method and apparatus for indirectly emitting new audible acoustic waves at acceptable volume levels from a region of air without the use of conventional transducers as the ultrasonic frequency source.

It is another object to indirectly generate at least one new sonic or subsonic wave having commercially acceptable volume levels by using a thin film emitter which provides interference between at least two ultrasonic signals having different frequencies equal to the at least one new sonic or subsonic wave.

It is still another object to provide a thin film speaker diaphragm capable of developing a uniform wave front across a broad ultrasonic emitter surface.

A still further object of this invention is to provide an improved speaker diaphragm capable of generating compression waves in response to electrical stimulation, yet which does not require a rigid diaphragm structure.

These objects are realized in a speaker which includes a thin, piezoelectric membrane disposed over a common emitter face having a plurality of apertures. The apertures are aligned so as to emit compression waves from the membrane along parallel axes, thereby developing a uniform wave front. The membrane is drawn into an arcuate configuration and maintained in tension across the apertures by a near vacuum which is created within a drum cavity behind the emitter membrane. The piezoelectric membrane responds to applied voltages to linearly distend or constrict, thereby modifying the curvature of the membrane over the aperture to yield a compression wave much like a conventional speaker diaphragm. This configuration not only enables compression wave generation, but also eliminates formation of adverse back-waves because of the applied vacuum.

In another aspect of the invention, the emitter includes a drum comprised of a single emitter membrane disposed over a plurality of apertures at a common emitter face. In this embodiment, however, the membrane is arcuately distended within the apertures by positive pressure applied from the drum cavity. Similar sonic manipulation of the membrane occurs in response to applied voltage; however, backwave generation must now be considered.

Another aspect of the invention is a polymer film disposed over the piezoelectric film to aid in sealing the film and avoiding gas leakage.

In yet another aspect of the invention, the emitter includes multiple electrodes to control separate areas of the piezoelectric film and to allow for beam steering and multiple channels in the film.

Other objects, features, advantages and alternative aspects of the present invention will become apparent to those skilled in the art from a consideration of the following detailed description, taken in combination with the accompanying drawings.

DETAILED DESCRIPTION OF THE INVENTION

Figure 1:
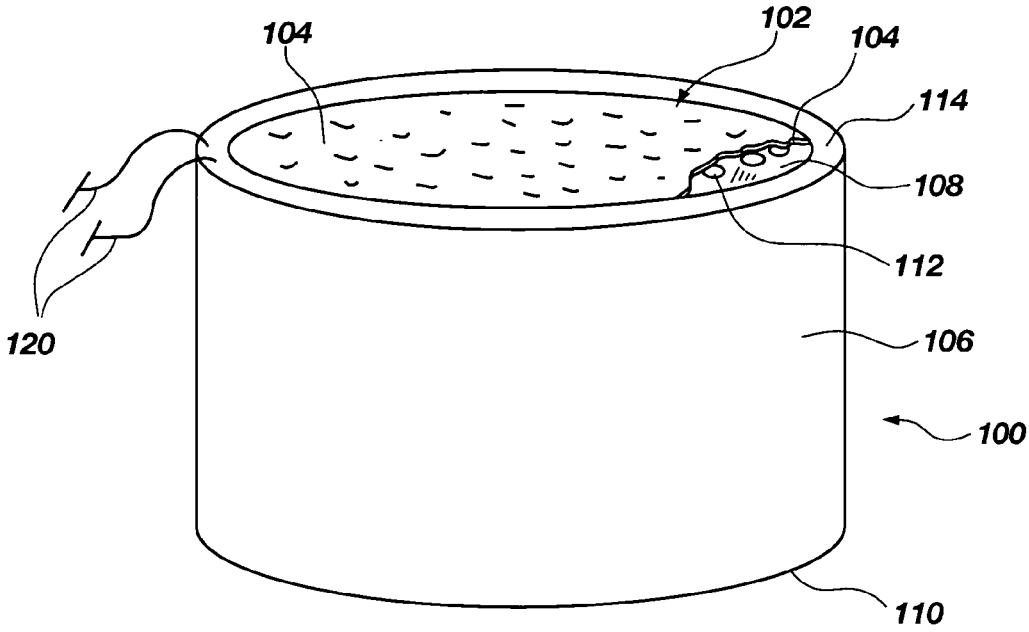
FIG. 1 is an orthogonal view of an emitter drum transducer made in accordance with the principles of the present invention.

The traditional use of piezoelectric transducers in a parametric array as a speaker member embodies numerous limitations which have apparently discouraged many practical applications of transducers within the audio and ultrasonic sound generation industries. Such limitations include lack of uniformity of phase and frequency response across a large array of individual transducers. Often, distortion, reduced output, and unintentional beam steering occur because of small variations in transducer resonant frequencies, as well as variable response to differing frequencies within a broad frequency spectrum. Many of these limitations arise because a typical speaker array is formed from many individual, nonuniform transducers respectively wired to a common signal source. Each transducer is somewhat unique and operates autonomously with respect to the other transducers in a parallel or series configuration.

The present invention develops congruity and uniformity across the array by providing a single film of piezoelectric material which is predictable in response to an applied signal across the full emitter face. This results, in large measure, because in a preferred embodiment the emitter is actually a single film of the same composition supported across a plurality of apertures of common dimension. Furthermore, the full emitter face is physically integrated because the material is simply disposed across the emitter plate or disk and is activated by a single set of electrical contacts. Therefore, the array of individual emitting locations, represented by the respective apertures in the emitter plate, are actually operating as a single film, composed of one material, which is activated by the same electrical input. Arcuate distention is uniform at each aperture because the same material is being biased in tension across the same dimension by a common pressure (positive or negative) from within the drum cavity. Harmonic and phase distortions are therefore minimized, facilitating a uniform wave front across the operable bandwidth.

FIGS. 1, 2, 3*a* and 3*b* depict a preferred embodiment of the present invention shown in orthogonal, partial cutaway view. The emitter drum transducer 100 is a hollow, generally cylindrical object. The sidewall 106 of the emitter drum transducer 100 is a metal or metal alloy. The emitter face 102 generates the compression waves from the top surface of the emitter drum transducer 100 and is comprised of at least two components—the emitter film 104 and the emitter plate or disk 108.

The outer surface of the emitter face 102 is formed by the thin piezoelectric film 104. This film 104 is supported by the rigid emitter plate 108 which includes a plurality of apertures for enabling distention of the film into small arcuate emitter elements. As mentioned above, these emitter elements are uniform in all respects—size, curvature and composition. This commonality results in a common output across the face of the emitter film as if it were a single emitter element.

The piezoelectric film 104 is stimulated by electrical signals applied through appropriate contacts 120 and is thereby caused to vibrate at desired frequencies to generate compression waves. This is facilitated by a conductive ring 114 which restrains the thin film in tension across the emitter plate or disk 108 in a manner similar to a drum head. The conductive ring is therefore positioned above the piezoelectric film 104 and disposed about the perimeter of the emitter face 102, and operates as both a clamp and electrical signal source for the piezoelectric material. Typically, this conductive ring 114 is made of brass, however, other electrically conductive materials could be utilized. A pressure seal 129 is set under the conductive ring 114 and serves to seal the joint between the piezoelectric film 104 and the drum sidewalls 106. Further, the pressure seal 129 can be used as the electrical contact around the edge of the piezoelectric film without the conductive ring 114. Essentially, the pressure seal 129 becomes the conductive or partially conductive ring.

The emitter drum transducer 100 is generally hollow inside, and is closed at a bottom surface by a back cover 110. This structure is sealed to enable a generally airtight enclosure or drum cavity. A near-vacuum (hereinafter referred to as a vacuum) or a pressurized condition can exist within the emitter drum transducer 100 for reasons to be explained later. The near-vacuum will be defined as a pressure which is small enough to require measurement in millitorrs.

Figure 2:
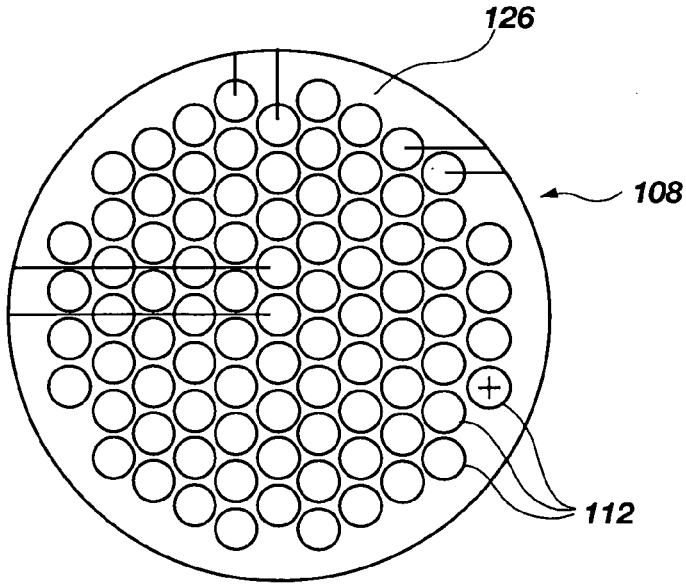
FIG. 2 is a top view showing a plurality of apertures in an emitter face of the emitter drum transducer made in accordance with the principles of the present invention.

To better understand the structure of the emitter drum transducer 100, FIG. 2 provides a top view of an outward facing face 126 of an isolated emitter disk 108 which is normally disposed underneath the piezoelectric film 104 (see FIG. 1). In the preferred embodiment, the disk 108 is metallic and perforated by a plurality of apertures 112 of generally uniform dimensions. The apertures 112 extend completely through the thickness of the disk 108 from an inward facing side 128 (see FIG. 3) to the outward facing side 126. To provide predictability and the greatest efficiency in performance, the apertures 112 are formed in the shape of cylinders.

The predictability in vibrations of the piezoelectric film 104 when suspended in arcuate tension over cylindrical apertures 112 is a consequence of a significant amount of knowledge which has been developed regarding the symmetrical bending of circular plates. This should not be construed to mean that other aperture 112 shapes cannot be used. Nevertheless, the preferred embodiment has adopted cylindrical apertures 112 as a predictable configuration.

The pattern of apertures 112 shown on the disk 108 in FIG. 2 is chosen in this case because it enables the greatest number of apertures 112 to be located within a given area. The pattern is typically described as a "honeycomb" pattern. The honeycomb pattern is selected because it is desirable to have a large number of apertures 112 with parallel axes because of the characteristics of acoustical heterodyning.

Specifically in the case of generating ultrasonic frequencies, it is desirable to cause heterodyning interference between a base frequency and a frequency which carries intelligence to thereby generate a new sonic or subsonic frequency which is comprised of the intelligence. Consequently, a greater number of base and intelligence carrying wave fronts which are caused to interact with each other will generally have the effect of generating a new sonic or subsonic frequency of greater volume as compared to a single pair of base and intelligence carrying frequencies. In other words, the present invention provides the significant advantage of developing large numbers of emitter elements for carrying the interfering frequencies, yet without losing the benefit of common composition, integration and vibrational response. Obviously, this is an important factor in generating a volume which is loud enough to be commercially viable. The parallel orientation of axes of frequency emission further enhance development of acceptable volume levels.

Figure 3A:
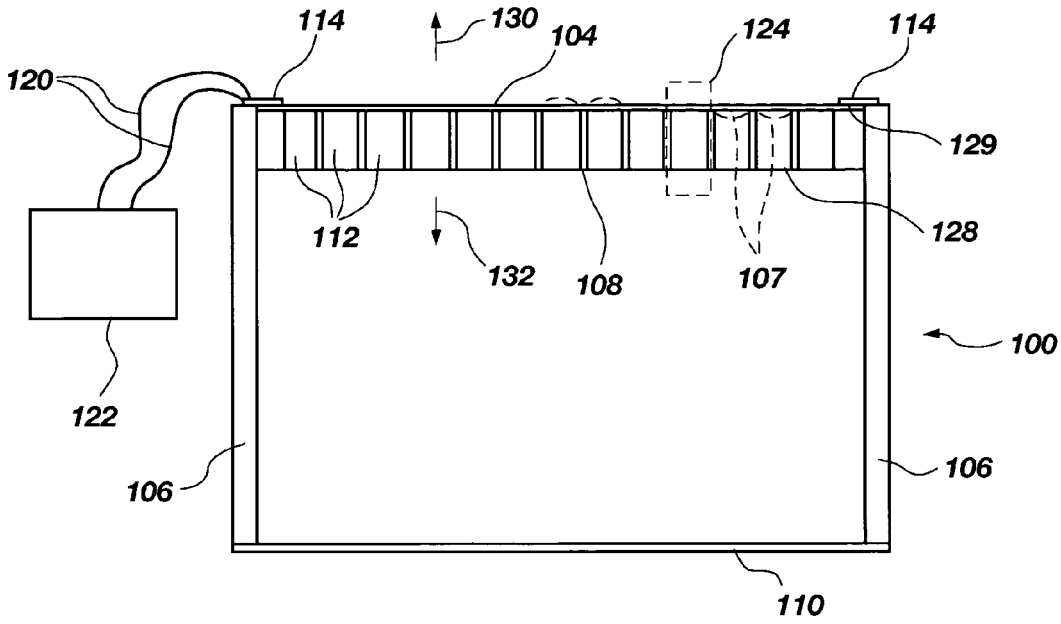
FIG. 3*a* is a cut-away profile view of the emitter drum transducer and the emitter face, showing the membrane which is disposed over the apertures in the emitter face.

FIG. 3*a* provides a helpful profile and cut-away perspective of the preferred embodiment of the present invention, including more detail regarding electrical connections to the emitter drum transducer 100. The sidewall 106 of the emitter drum transducer 100 provides an enclosure for the disk 108, with its plurality of apertures 112 extending therethrough. The piezoelectric film 104 is shown as being in contact with the disk 108. Experimentation was used to determine that it is preferable not to glue the piezoelectric film 104 to the entire exposed surface of the disk 108 with which the piezoelectric film 104 is in contact. The varying size of glue fillets between the piezoelectric film 104 and the apertures 112 causes the otherwise uniform apertures 112 to generate resonant frequencies which were not uniform. Therefore, the preferred embodiment teaches only gluing an outer edge of the piezoelectric film 104 to the disk 108.

The back cover 110 is provided to permit a vacuum within the emitter drum transducer 100. This vacuum causes the piezoelectric film 104 to be pulled against the disk 108 in a generally uniform manner across the apertures 112. Uniformity of tension of the piezoelectric film 104 suspended over the apertures 112 is important to ensure uniformity of the resonant frequencies produced by the piezoelectric film 104 at each emitter element. In effect, each combination of piezoelectric film 104 and aperture 112 forms a miniature emitter element or cell 124. By controlling the tension of the piezoelectric film 104 across the disk 108, the cells 124 advantageously respond generally uniform.

An additional benefit of a vacuum is the elimination of any possibility of undesirable "back-wave" distortion. Elimination of the back-wave in the present invention arises from the presence of the vacuum in the sealed drum cavity. By definition, a compression wave requires that there be a compressible medium through which it can travel. If the piezoelectric film 104 can be caused to generate ultrasonic compression waves "outward" in the direction indicated by arrow 130 from the emitter drum transducer 100, it is only logical that ultrasonic compression waves are also being generated from the piezoelectric film 104 which will travel in an opposite direction, backwards into the emitter drum transducer 100 in the direction indicated by arrow 132.

In the absence of the vacuum condition, these backward traveling or back-wave distortion waves could interfere with the ability of the piezoelectric film 104 to generate desired frequencies. This interference could occur when the back-waves reflect off surfaces within the emitter drum transducer 100 until they again travel up through an aperture 112 and reflect off of the piezoelectric film 104, thus altering its vibrations. Therefore, by eliminating the medium for travel of compression waves (air) within the emitter drum transducer 100, reflective vibrations of the piezoelectric film 104 are eliminated.

FIG. 3*a* also shows that there are electrical leads 120 which are electrically coupled to the piezoelectric film 104 and which carry an electrical representation of the frequencies to be transmitted from each cell 124 of the emitter drum transducer 100. These electrical leads 120 are thus necessarily electrically coupled to some signal source 122 as shown.

Because of the potential for pressure leakage from or into the drum 100 when it is pressurized, it is important to take steps which avoid pressure leakage. One method of decreasing pressure leakage is to use a noble gas to pressurize the drum 100. For example, a heavy noble gas such as nitrogen, neon or argon may be used to reduce the leakage. The noble gases have larger molecules than lighter gases and thus reduce leakage from the drum 100 or through the piezoelectric film 140.

Figure 3B:
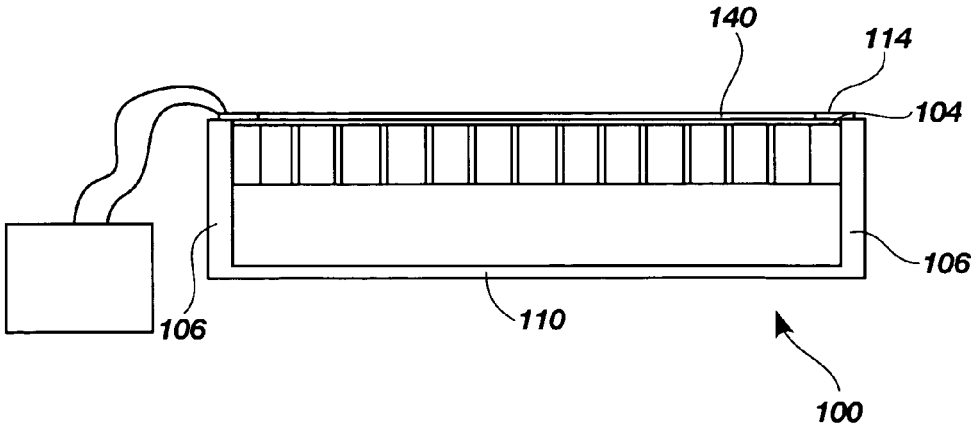
FIG. 3*b* is a cut-away profile view of the emitter drum transducer and the emitter face, showing a polymer film adhered over the piezoelectric film.

In another embodiment of the invention, a thin polymer layer is used to coat the piezoelectric film. FIG. 3*b* shows a polymer layer 140 which is coated onto the piezoelectric film 104 after the polarization process. During the polarization process the piezoelectric film is stretched and charged, which weakens the gas retention properties of the piezoelectric film. The polymer layer coating seals the piezoelectric film so that atmospheric gas cannot leak into the drum 100 when it contains a near vacuum. It also seals the piezoelectric film to prevent the escape of gas used to pressurize the drum 100. It is important to note that the polymer must be thin enough that it does not affect the performance of the piezoelectric film. Using the extra layer of plastic coating allows the pressure in the drum 100 to be more reliable even when very thin piezoelectric film is used. It should be realized that a plastic coating can also be used on the sidewalls 106 and back cover 110 of the drum to reduce pressure leakage. Sealing the piezoelectric film or the drum 100 helps to extend the useful life of the emitter. The pressure range of a emitter shown in the current embodiment is approximately 0 pounds per square inch (near vacuum) to approximately 20 pounds per square inch (psi).

Figure 3C:
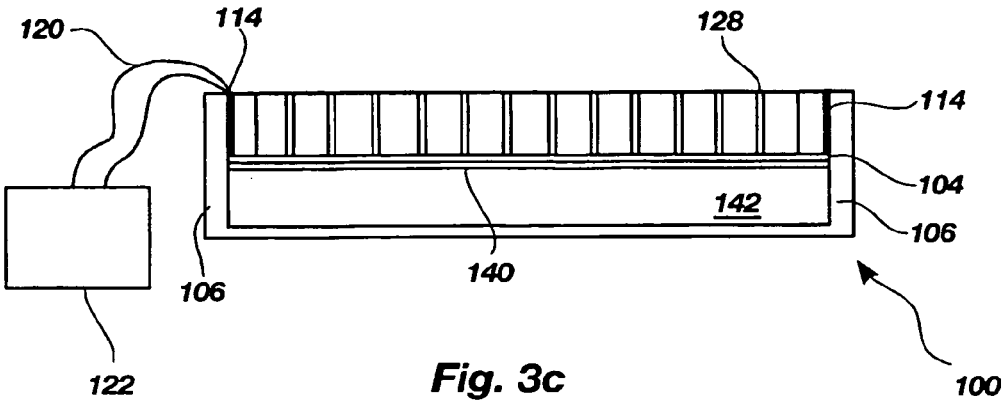
FIG. 3*c* is a cut-away profile view of the emitter drum and emitter plate, showing the piezoelectric film on the inside of the emitter plate.
Figure 3D:
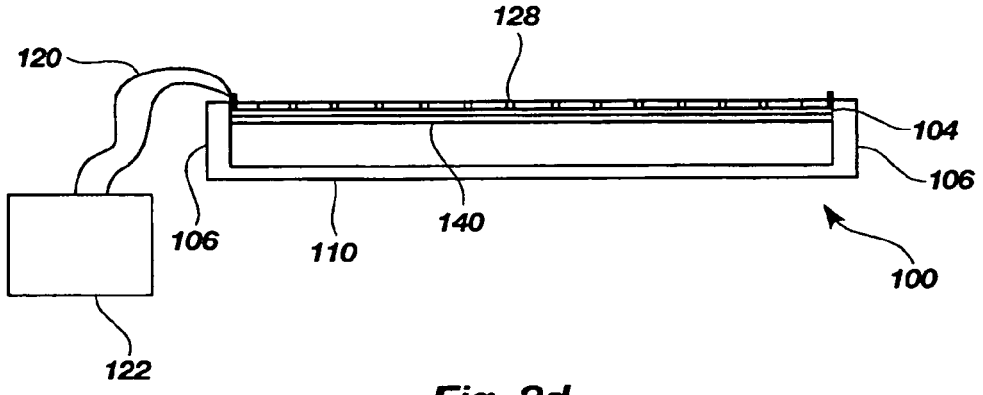
FIG. 3*d* is a cut-away profile view of the emitter drum and a thin emitter plate, showing the piezoelectric film on the inside of the emitter plate.

FIG. 3*c* shows a cut-away profile view of an emitter drum and emitter face. In this configuration, the piezoelectric film is on the inside of the emitter face. The chamber 142 is pressurized to push the piezoelectric film 104 into an arcuate shape as shown in FIG. 4*b*. A polymer coating layer 140 is used to aid in sealing the piezoelectric film, as described above. The emitter face 128 shown in this figure is an embodiment with a relatively significant cell depth. FIG. 3*d* shows an embodiment which is similar to FIG. 3*c* with the exception that the thickness of the emitter plate 128 is substantially less than the depth of the emitter plate 128 in FIG. 3*c*. The chamber 142 is also pressurized to push the piezoelectric film 104 into an arcuate shape as shown in FIG. 4*b*.

Figure 3E:
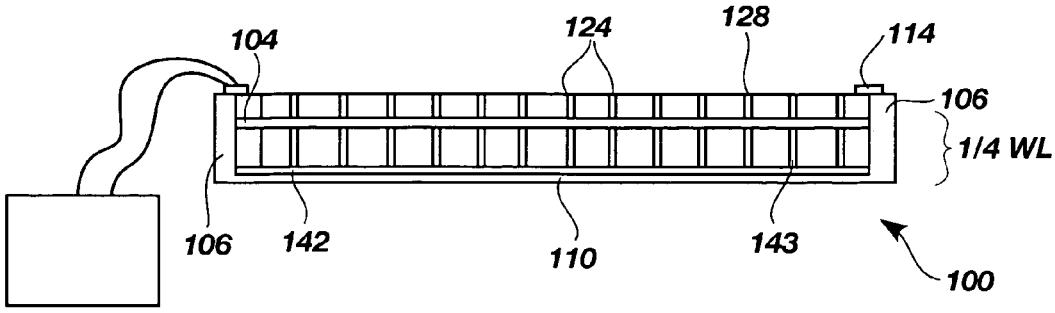
FIG. 3*e* is a cut-away profile view of the emitter drum and a thin emitter plate and a second clamp on the opposing side of the piezoelectric film.

FIG. 3*e* shows a cut-away side view of an emitter drum 100 with an emitter face 128 and a second clamp 143. The piezoelectric film 104 is clamped between the emitter face 128 and the second clamp 143 which matches the aperture configuration of the emitter face 128. The piezoelectric film 104 is ¼ of a wave length (¼ wL) from the back plate 110 of the drum to reinforce the wave generation. When the drum 100 is pressurized, it produces arcuate emitter elements. In addition, there is an elongated chamber 142 which connects the cells 124 with tiny openings. It should be realized that the cells 124 can also be attached to the back plate 110 and then openings at other points in the cells 124 are placed to equalize the pressure in each of the cells. The second clamp 143 is not required, but it adds stability to the piezoelectric film 104.

Figure 4A:
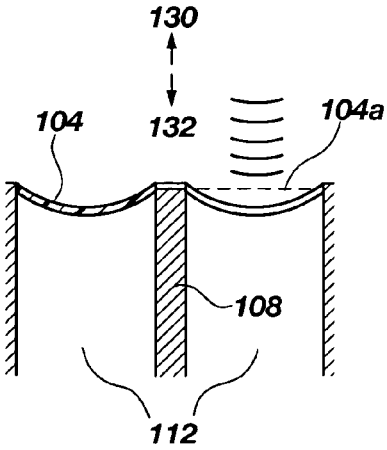
FIG. 4 is a close-up profile view of the membrane which is vibrating while stretched over a plurality of the apertures in the emitter face.
Figure 4B:
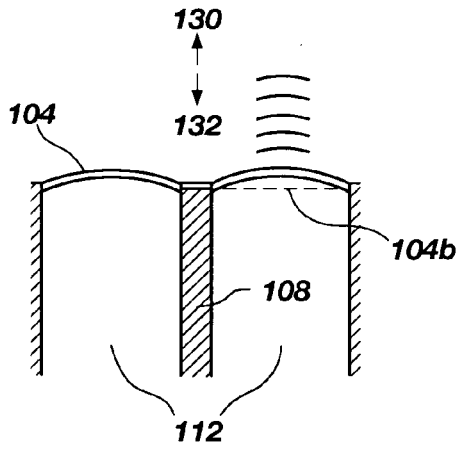

FIG. 4A is a close-up profile view of two of the cells 124 (comprised of the piezoelectric film 104 over two apertures 112) of the preferred embodiment. The piezoelectric film 104 is shown distended inward toward the interior of the emitter drum transducer 100 in an exaggerated vibration for illustration purposes only. It should be apparent from a comparison with FIG. 4B that the distention inward of the piezoelectric film 104 will be followed by a distention outward and away from the interior of the emitter drum transducer 100 with relaxation of the applied signal. The amount of distention of the piezoelectric film 104 is again shown exaggerated for illustration purposes only. The actual amount of distention will be discussed later.

Figure 5:
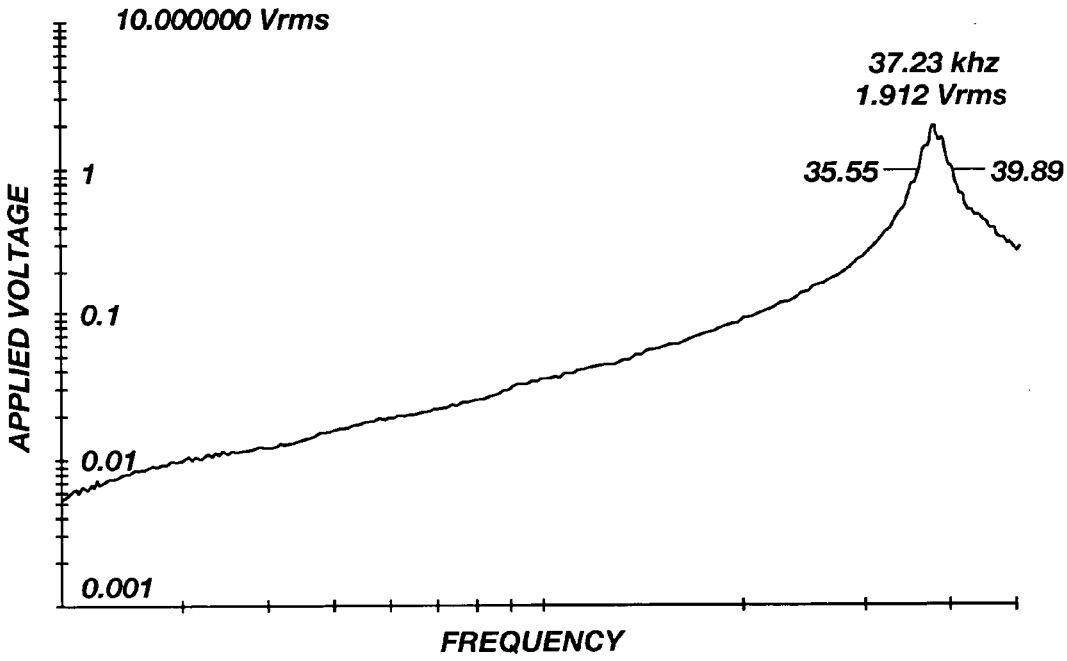
FIG. 5 is a graph showing an example of membrane (piezoelectric film) displacement versus frequency in the preferred embodiment. The graph shows resonant frequency and typical bandwidth generated therefrom.

FIG. 5 is a graph showing frequency response of the emitter drum transducer 100 produced in accordance with the principles of the preferred embodiment as compared to displacement of the piezoelectric film 104 (as a function of applied voltage RMS). The emitter drum transducer 100 which provided the graph of FIG. 5 is exemplary of typical results had with a near vacuum in the interior of the emitter drum transducer 100.

The membrane (piezoelectric film 104) used in this embodiment is a polyvinylidiene di-fluoride (PVDF) film of approximately 28 micrometers in thickness. Experimentally, the resonant frequency of this particular emitter drum transducer 100 is shown to be approximately 37.23 kHz when using a drive voltage of 73.6 $V_{pp}$, with a bandwidth of approximately 11.66 percent, where the upper and lower 6 dB frequencies are 35.55 kHz and 39.89 kHz respectively. The maximum amplitude of displacement of the piezoelectric film 104 was also found to be approximately just in excess of 1 micrometer peak to peak. This displacement corresponds to a sound pressure level (SPL hereinafter) of 125.4 dB.

What is surprising is that this large SPL was generated from an emitter drum transducer 100 using a PVDF which is theoretically supposed to withstand a drive voltage of 1680 $V_{pp}$, or 22.8 times more than what was applied. Consequently, the theoretical limit of these particular materials used in the emitter drum transducer 100 result in a surprisingly large SPL of 152.6.

It is important to remember that the resonant frequency of the preferred embodiment shown herein is a function of various characteristics of the emitter drum transducer 100. These characteristics include, among other things, the thickness of the piezoelectric film 104 stretched across the emitter face 102, and the diameter of the apertures 112 in the emitter disk 108. For example, using a thinner piezoelectric film 104 will result in more rapid vibrations of the piezoelectric film 104 for a given applied voltage. Consequently, the resonant frequency of the emitter drum transducer 100 will be higher.

The advantage of a higher resonant frequency is that if the percentage of bandwidth remains at approximately 10 percent or increases as shown by experimental results, the desired range of frequencies can be easily generated. In other words, the range of human hearing is approximately 20 to 20,000 Hz. Therefore, if the bandwidth is wide enough to encompass at least 20,000 Hz, the entire range of human hearing can easily be generated as a new sonic wave as a result of acoustical heterodyning. Consequently, a signal with sonic intelligence modulated thereon, and which interferes with an appropriate carrier wave, will result in a new sonic signal which can generate audible sounds across the entire audible spectrum of human hearing.

In addition to using a thinner piezoelectric film 104 to increase the resonant frequency, there are other ways for extending frequency range. For example, in an alternative embodiment, the present invention uses a cell 124 having a smaller diameter aperture 112. A smaller aperture will also result in a higher resonant frequency for an applied driving voltage.

While some of the results have been explained, it is also useful to examine some of the equations which may be representative of the dynamics of the present invention. For a theoretical analysis of the film tensions and resonant frequencies please refer to the published works *Vibrating Systems and their Equivalent Circuits* by Zdenek Skvor, 1991 Elsevier, *Marks Standard Handbook for Mechanical Engineers*, Ninth Edition by Eugene A. Avallone and Theodore Baumeister III, and *Theory of Plates and Shells* by Stephen Timoshenko, 2nd edition. Marks' gives a very useful equation (5.4.34) which correlates tension in a membrane to resonant frequency. Resonant frequencies are a function of aperture shape, aperture dimension, back pressure, film compliance and film density. Relationships between these values are complex and beyond the scope of this document.

Figure 6:
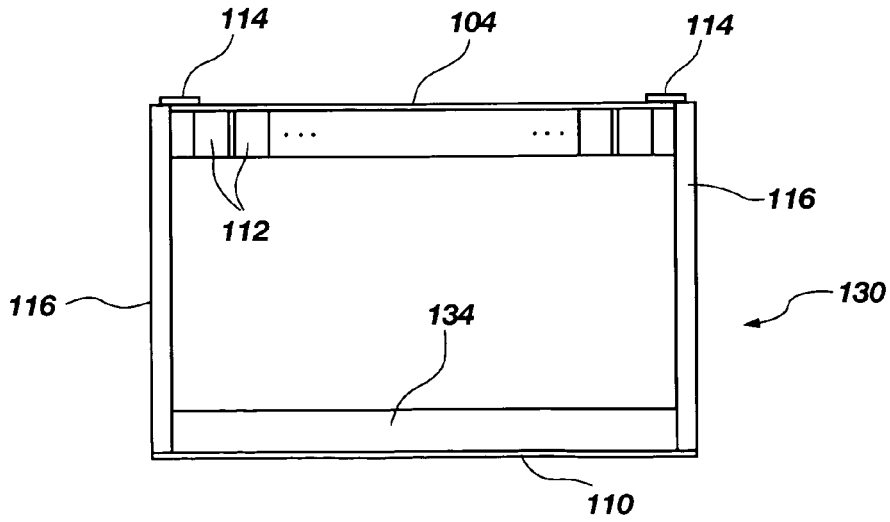
FIG. 6 is a cut-away profile view of the emitter drum transducer of an alternative embodiment where the emitter drum transducer is pressurized.

FIG. 6 shows an alternative embodiment of the present invention, but which also generates frequencies from an emitter drum transducer 116 and is constructed almost identically to the preferred embodiment. The essential difference is that instead of creating a vacuum within the interior of the emitter drum transducer 116, the interior is now pressurized. The piezoelectric film 104 is on the inside of the emitter face and held in place in part by the pressure in the drum.

The pressure introduced within the emitter drum transducer 116 can be varied to alter the resonant frequency. However, the thickness of the piezoelectric film 104 remains a key factor in determining how much pressure can be applied. This can be attributed in part to those piezoelectric films made from some copolymers having considerable an anisotropy, instead of biaxially stretched PVDF used in the preferred embodiment. The undesirable side affect of an anisotropic piezoelectric film is that it may in fact prevent vibration of the film in all directions, resulting in asymmetries which will cause unwanted distortion of the signal being generated therefrom. Consequently, PVDF is the preferred material for the piezoelectric film not only because it has a considerably higher yield strength than copolymer, but because it is considerably less anisotropic.

One aspect of the alternative embodiment of a pressurized emitter drum transducer 116 can be the occurrence of frequency resonances or spurs. This is due to back-wave generation within the emitter drum transducer 116, which arise from wave generation in the gas within the emitter drum transducer 116. However, it was also determined that the back-wave could be eliminated by placing a material within the emitter drum transducer 116 to absorb the back-waves. For example, a piece of foam rubber 134 or other acoustically absorbent or dampening material which is inserted into the emitter drum transducer 116 can generally eliminate all frequency spurs. Alternatively a backplate may be placed close enough to the piezoelectric film to substantially eliminate wave generation in a specific range of interest.

Experimental results using the pressurized emitter drum transducer 116 showed that at typical selected pressures and drive voltages, the emitter drum transducer 116 operated in a substantially linear region. For example, it was determined that an emitter drum transducer 116 using a 28 micrometer thick PVDF with a pressure of 10 pounds per square inch (psi) inside the emitter drum transducer 116 can generate a resonant frequency approximately 43 percent greater than an emitter drum transducer 116 which has an internal pressure of 5 psi. Alternatively, it was confirmed that a generally linear region of operation was discovered when it was determined that doubling the drive amplitude also generally doubles the displacement of the PVDF.

It was also experimentally determined that the pressurized emitter drum transducer 116 could generally obtain bandwidths of approximately 20 percent. Therefore, constructing an emitter drum transducer 116 having a resonant frequency of only 100 KHz results in a bandwidth of approximately 20 KHz, more than adequate to generate the entire range of human hearing. By acoustically damping the interior of the emitter drum transducer 116 to prevent introducing back-wave distortions or internal rear wave resonances, the pressurized embodiment is also able to achieve the impressive results of commercially viably volume levels of the preferred embodiment of the present invention.

The preferred thickness of the piezoelectric film, the aperture size, and the drum pressure will now be discussed. When the pressure is increased, it increases the resonant frequency of the speaker. The resonant frequency can also be increased by decreasing the aperture size or increasing the thickness of the piezoelectric film. The following table shows some preferred film thicknesses, aperture sizes and pressures to provide a resonant frequency of 35 kHz. These specific parameters provide the greatest output for the current invention. It should be apparent that a number of combinations could be used which fall within or near these ranges.

TABLE 1

| Film Thickness | Aperture Diameter | Drum Pressure |
|---|---|---|
| 9 micrometers | 0.160 inches | 5 PSI |
| 12 micrometers | 0.168 inches | 6 PSI |
| 25 micrometers | 0.200 inches | 12 PSI |

Although Table 1 lists selected aperture sizes, the preferred aperture sizes fall in the range of 0.050 inches to 0.600 inches. The parameters listed in Table 1 are primarily focused on ultrasonic transducers. The actual performance of the film depends on different factors, such as whether the film is biaxial, uniaxial, or coated, etc. For example, a 9 micrometer film used at 5 PSI generates a resonant frequency of 35 kHz with a 0.160 inch aperture. In contrast, another 9 micrometer film covered with PVDC coating must have a 0.600 inch aperture at 5 PSI to produce the same 35 kHz resonant frequency. Although the previous examples of aperture sizes are directed to ultrasonic embodiments of the invention, larger holes can be used to directly produce useful sonic frequencies.

The spacing between the aperture centers is preferred to be between ¼ to ½ of a frequency wavelength (¼ to ½ wL) which is targeted for the maximum output. The preferred spacing between the aperture centers is ⅓ the frequency wavelength where the maximum output is desired.

A further favorable aspect of the present invention is the adaptability of the shape of the sonic emitter to specific applications. For example, any shape of drum can be configured, provided the thin piezoelectric film can be maintained in uniform tension across the disk face. This design feature permits speaker configurations to be fabricated in designer shapes that provide a unique decor to a room or other setting. Because of the nominal space requirements, a speaker of less than an inch in thickness can fabricated, using perimeter shapes that fit in corners, between columns, as part of wall-units having supporting high fidelity equipment, etc. Uniformity of tension of the emitter film across irregular shapes can be accomplished by stretching the film in a plane in an isotropic manner, and then gluing the film at the perimeter of the disk face. Excess film material can then be cut free or folded, and then enclosed with a peripheral band to bind the front and back walls, and intermediate drum wall into an integral package. Such speakers have little weight and merely required wire contacts coupled at the piezoelectric material for receiving the signal, and a pressure line for applying vacuum or positive pressure to distend the film into curvature.

Figure 7:
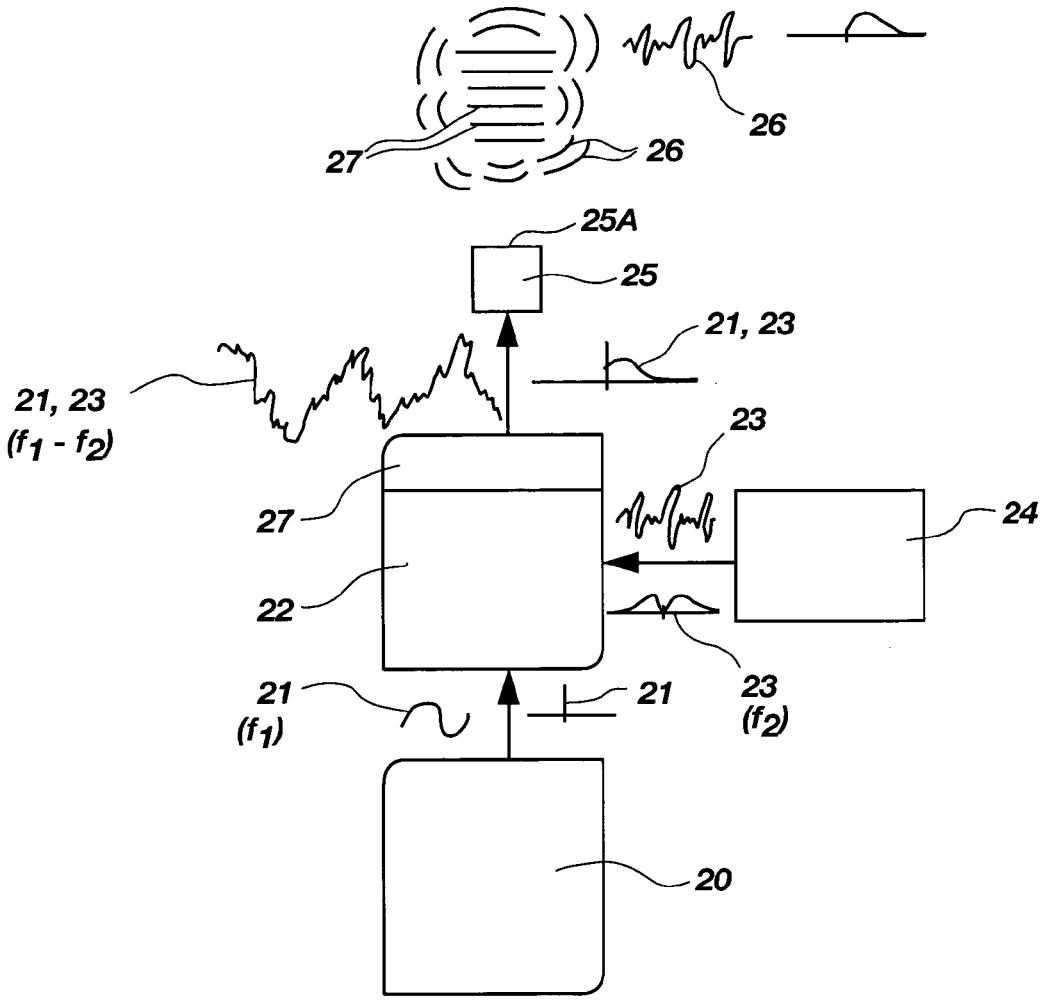
FIG. 7 is a more specific implementation of the present invention which transmits an ultrasonic base frequency and an ultrasonic intelligence carrying frequency which acoustically heterodyne to generate a new sonic or subsonic frequency.

Turning to a more specific implementation of the preferred embodiment of the present invention, the emitter drum transducer 100 can be included in the system shown in FIG. 7. This application utilizes a parametric or heterodyning technology, which is particularly adapted for the present thin film structure. The thin, piezoelectric film is well suited for operation at high ultrasonic frequencies in accordance with parametric speaker theory.

A basic system includes an oscillator or digital ultrasonic wave source 20 for providing a base or carrier wave 21. This wave 21 is generally referred to as a first ultrasonic wave or primary wave. An amplitude modulating component 22 is coupled to the output of the ultrasonic generator 20 and receives the base frequency 21 for mixing with a sonic or subsonic input signal 23. The sonic or subsonic signal may be supplied in either analog or digital form, and could be music from any convention signal source 24 or other form of sound. If the input signal 23 includes upper and lower sidebands, a filter component may included in the modulator to yield a single sideband output on the modulated carrier frequency for selected bandwidths.

The emitter drum transducer is shown as item 25, which is caused to emit the ultrasonic frequencies $f_1$ and $f_2$ as a new wave form propagated at the face of the thin film transducer 25*a*. This new wave form interacts within the nonlinear medium of air to generate the difference frequency 26, as a new sonic or subsonic wave. The ability to have large quantities of emitter elements formed in an emitter disk is particularly well suited for generation of a uniform wave front which can propagate quality audio output and meaningful volumes.

The present invention is able to function as described because the compression waves corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds non-linearly under different conditions. This non-linearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. While a single transducer carrying the AM modulated base frequency was able to project sound at considerable distances and impressive volume levels, the combination of a plurality of co-linear signals significantly increased the volume. When directed at a wall or other reflective surface, the volume was so substantial and directional that it reflected as if the wall were the very source of the sound generation.

An important feature of the present invention is that the base frequency and single or double sidebands are propagated from the same transducer face. Therefore, the component waves are perfectly collimated. Furthermore, phase alignment is at maximum, providing the highest level of interference possible between two different ultrasonic frequencies. With maximum interference insured between these waves, one achieves the greatest energy transfer to the air molecules, which effectively become the "speaker" radiating element in a parametric speaker. Accordingly, the inventors believe the enhancement of these factors within a thin film, ultrasonic emitter array as provided in the present invention has developed a surprising increase in volume to the audio output signal.

The development of full volume capacity in a parametric speaker provides significant advantages over conventional speaker systems. Most important is the fact that sound is reproduced from a relatively massless radiating element. Specifically, there is no radiating element operating within the audio range, because the piezoelectric film is vibrating at ultrasonic frequencies. This feature of sound generation by acoustical heterodyning can substantially eliminate conventional distortion effects, most of which are caused by the radiating element of a conventional speaker. For example, adverse harmonics and standing waves on the loudspeaker cone, cone overshoot and cone undershoot are substantially eliminated because the low mass, thin film is traversing distances in micrometers.

Figure 8:
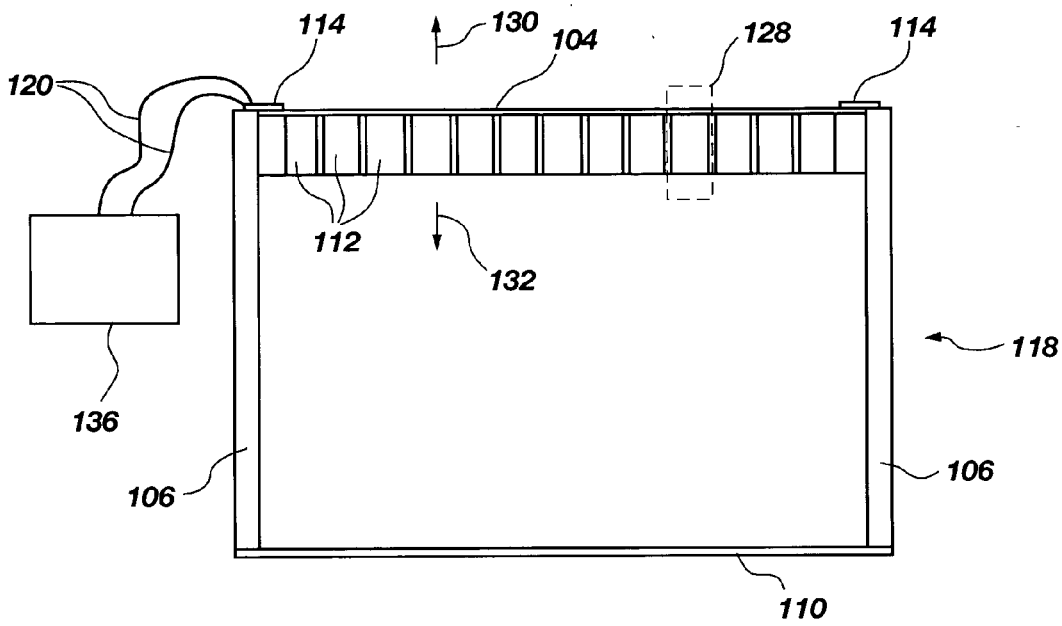
FIG. 8 is an alternative embodiment showing a cut-away profile view of a sensor drum transducer and the sensor face, showing the sensing membrane which is disposed over the apertures in the sensor face.

Another alternative embodiment of the present invention is shown in FIG. 8. It should be apparent that after understanding how the present invention operates as an emitter in the preferred embodiment, it can likewise be used as a receiver or sensor. This is a consequence of the piezoelectric film not only being able to convert electrical energy into mechanical energy, but to do the opposite and convert mechanical energy into electrical energy as well. Therefore, the apparatus of the preferred embodiment is only modified in that instead of a signal source 122 being coupled to the emitter drum transducer 100, the sensing drum is connected to a sensing instrument such as an oscilloscope. Then, transducer 118 converts compression waves which impinge upon the piezoelectric film 104 of the sensing drum transducer 118 into electrical signals essentially working as film 104 to an efficient microphone.

Figure 9:
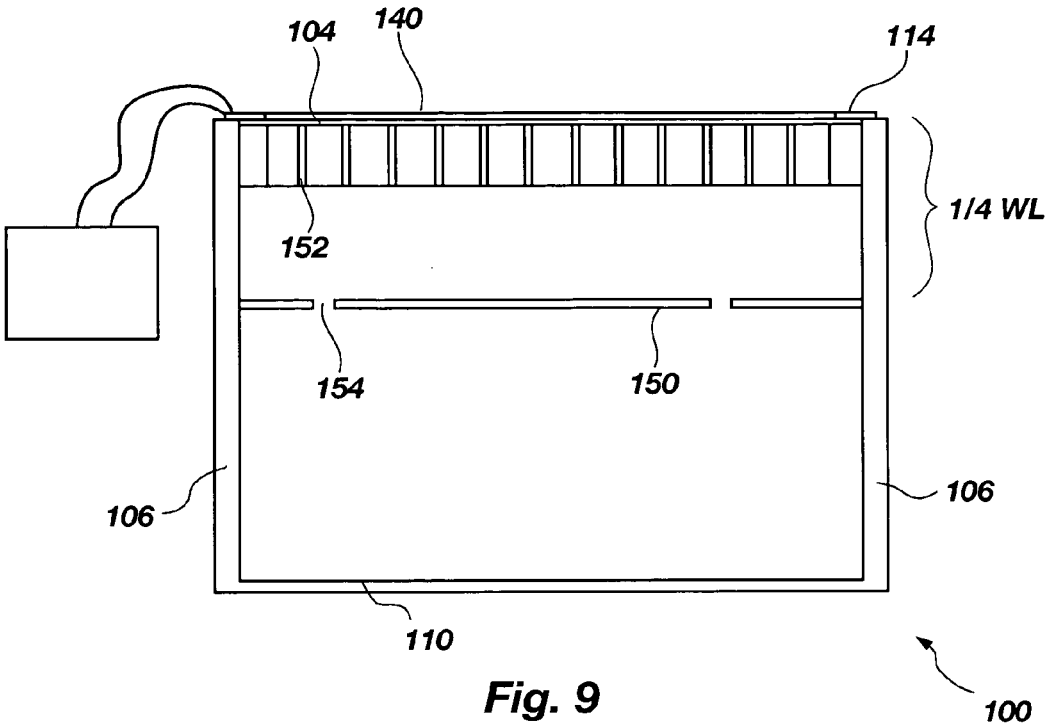
FIG. 9 is a cut-away profile view of an emitter showing a backwave reinforcment structure at ¼ of a wavelength from the emitter face.
Figure 10:
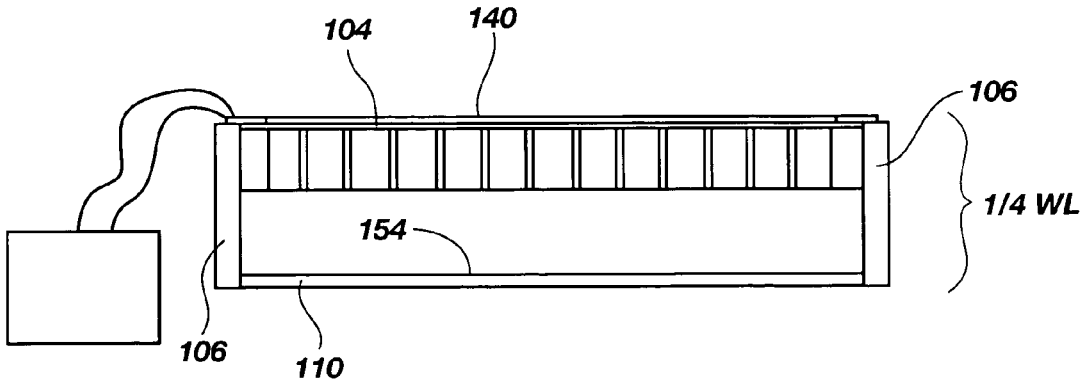
FIG. 10 is a cut-away profile view of an emitter showing the back cover as a backwave reinforcment structure at ¼ of a wavelength from the emitter face.

FIG. 9 shows a speaker device with a backwave reinforcement structure 150 behind the rigid emitter plate 152. The backwave reinforcement is preferred to be at ¼ of the distance of a selected wavelength from the piezoelectric film, shown as ¼ wL in FIG. 9. This reinforcement structure aids in the generation of the actual sonic or ultrasonic waves which are produced, because the backwave reinforcement will reflect the out of phase backwave so that it becomes an in phase wave with the primary waves produced to the environment. If the backwave reinforcement is not the back cover 110, then the reinforcement will also contain small apertures 154 to allow for pressure equalization. FIG. 10 shows an alternative arrangement of this embodiment where the backwave reinforcement structure is the back cover 110. The distance of ¼ of a wavelength from the piezoelectric film is dependent on the desired frequency wavelength to be reinforced. The most common wavelengths which will be reinforced are the carrier frequency or the resonant frequency. When the reinforcement takes place at ¼ of a wavelength from the piezoelectric film, the final output of the emitter can be increased by up to 3 dB. It is important to add that the backwave reinforcement structure can also be placed at different distances from the piezoelectric film depending on the wavelength of the frequency that is desired to be reinforced. Two other desirable reinforcement distances are ½ of a wavelength and 1 wavelength from the piezoelectric film.

Figure 11:
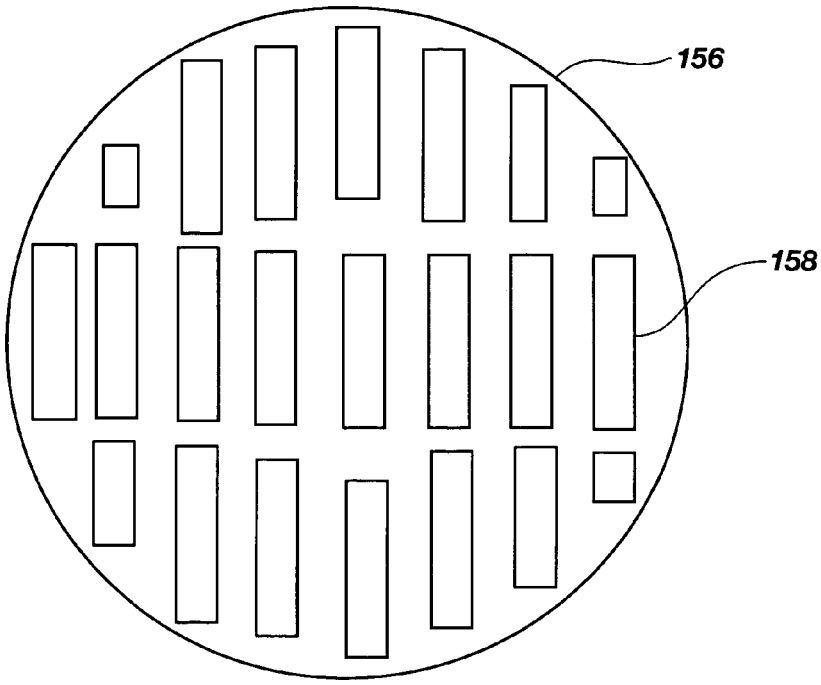
FIG. 11 is a top view of an emitter face with rectangular cell openings.
Figure 12:
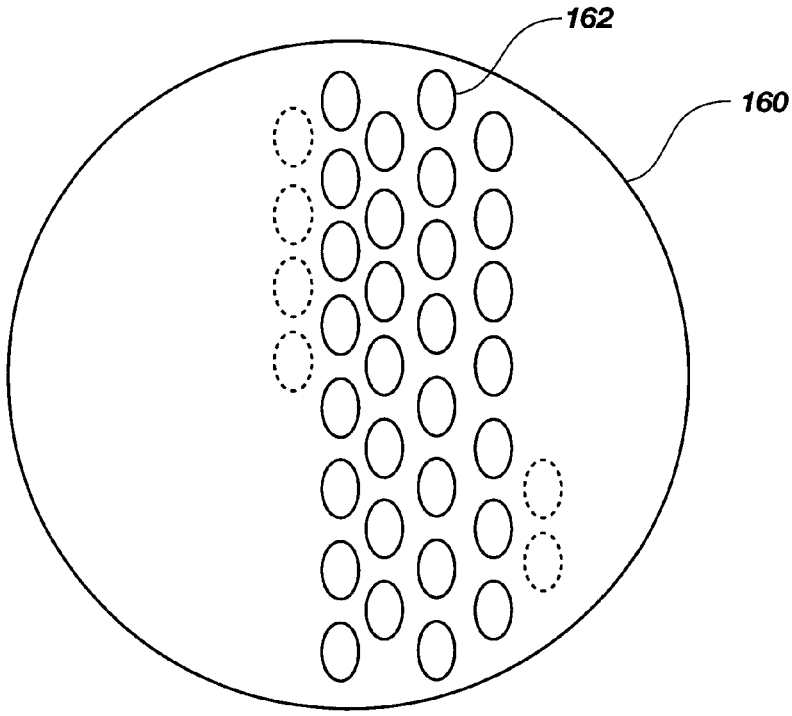
FIG. 12 is a top view of an emitter face with ellipsoid cell openings.

Another embodiment of this invention uses apertures which are not round. The round apertures are effective because of their symmetric shape but other symmetric shapes may be used. FIG. 11 shows a rigid emitter plate 156 which uses rectangular shaped apertures 158. FIG. 12 shows a rigid emitter plate 160 which has ellipsoid 162 shaped apertures. The rectangular and ellipsoid shapes are particularly effective with an anisotropic or uni-axial film. This is because an effective wave can be generated when the piezoelectric film constricts or expands perpendicular to the lengthwise axis of the rectangle or ellipse.

Figure 13:
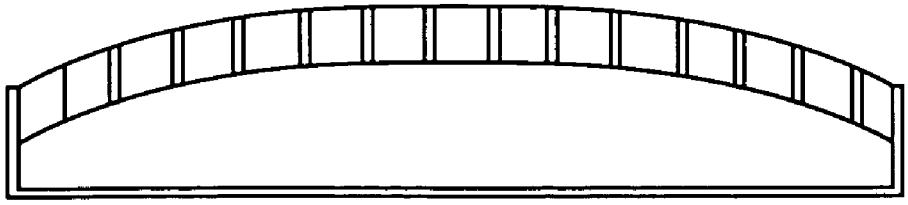
FIG. 13 is a cut-away profile view of an emitter with a convex emitter face.
Figure 14:
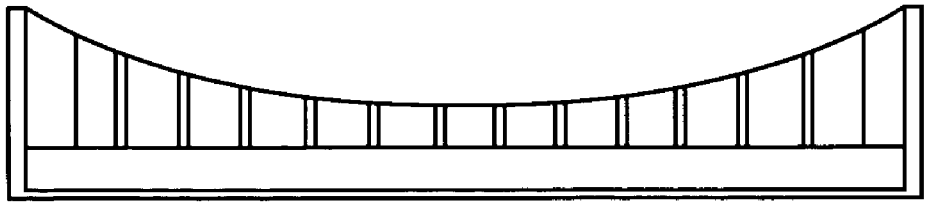
FIG. 14 is a cut-away profile view of an emitter with a concave emitter face.

FIG. 13 is an embodiment of the speaker with a convex emitter plate. The convex shape of the emitter allows the sound generated to be dispersed over a broader area than the flat faced embodiment. As the curve in the emitter face increases, the dispersion also increases. In contrast, FIG. 14 shows a concave emitter plate which focuses the directivity of the speaker.

Figure 15:
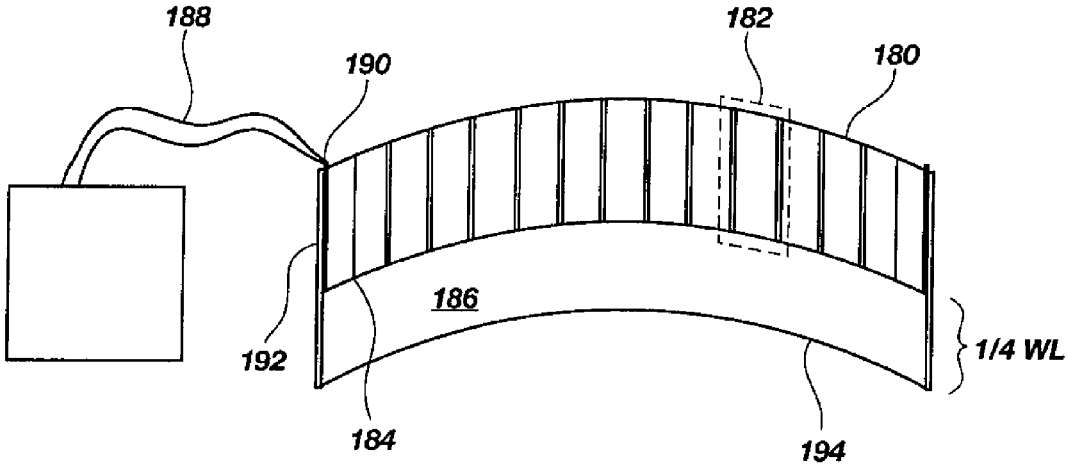
FIG. 15 is a cut-away profile view of an emitter with a convex emitter face, the piezoelectric film on the inside of the emitter face, and a convex backplate.
Figure 16:
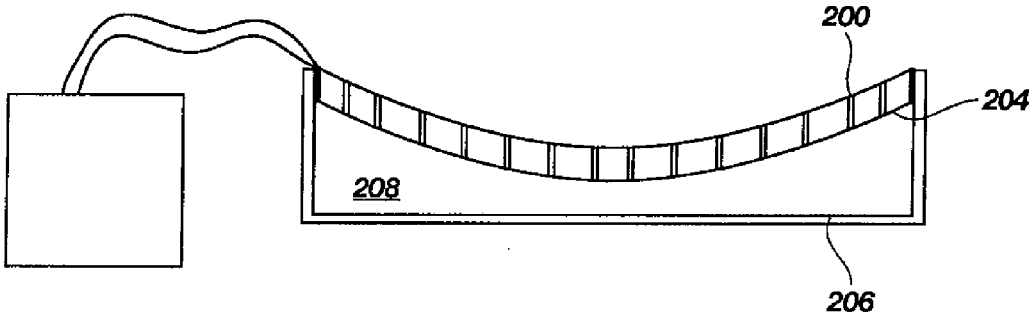
FIG. 16 is a cut-away profile view of an emitter with a concave piezoelectric film on the inside of the emitter plate.

FIG. 15 has a curved emitter plate 180 for dispersing the sound generated by the emitter cells 182. The piezoelectric film 184 is disposed beneath the emitter plate 180 and the chamber 186 is pressurized to form arcuate elements. An A.C. audio signal is applied through wires 188 connected to an electrical contact 190 which runs down between the chamber wall 192 and the emitter plate 180. The back cover 194 of the chamber is also curved and set a distance of ¼ of a selected frequency from the piezoelectric film. The selected frequency is the frequency to be reinforced by the backwave. FIG. 16 includes an emitter plate 200 with a flat face and a curved bottom portion to produce a concave piezoelectric film 204 configuration. The back cover 206 is flat and the chamber 208 formed by the drum is pressurized to form arcuate emitter sections as described before. It should be apparent based on this disclosure that the back cover 206 or the face of the emitter plate 200 could also be curved in a convex or concave manner if desired.

Figure 17:
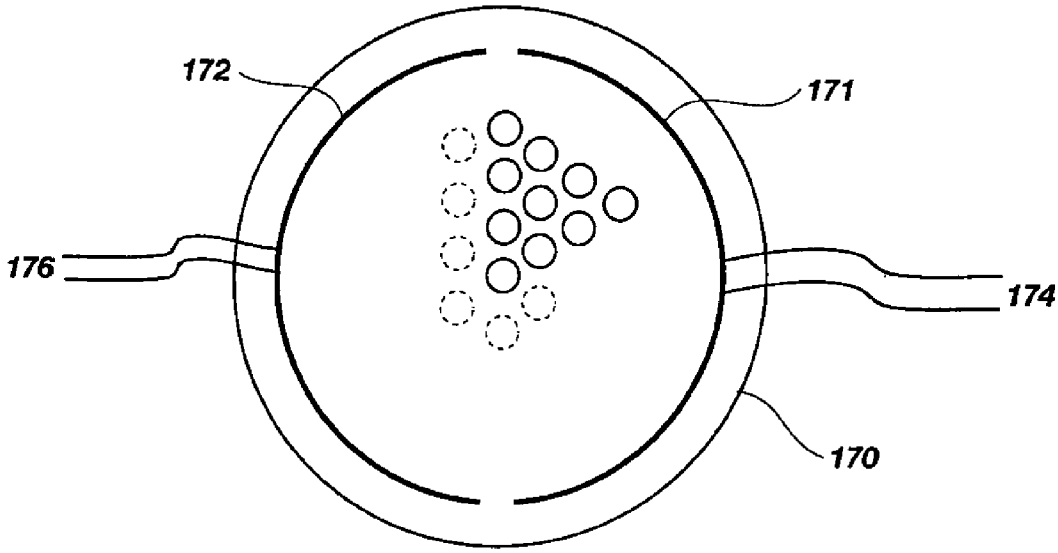
FIG. 17 is a top view of an emitter face with two semi-circular electrical contacts.

In yet another embodiment of the invention, the electrodes on the emitter plate are not a complete ring. FIG. 17 shows an emitter face 170 with two electrical contacts which are semi-circles. The first electrical contact 171 and the second electrical contact 172 can have separate signals applied to them. This allows regions of the piezoelectric film to be controlled independently. The signals applied to the different electrical contacts may be phase shifted, which produces corresponding waves in the air which are phase shifted. When these adjacent phase shifted waves interact at the ultrasonic level, it alters the directional path of the waves. By providing the proper phase relationships, the sound beam can be "steered" without physically moving the speaker. This provides the effect of movement for a user. In addition, multiple channels may also be applied through the separate electrical contacts 174, 176.

Figure 18:
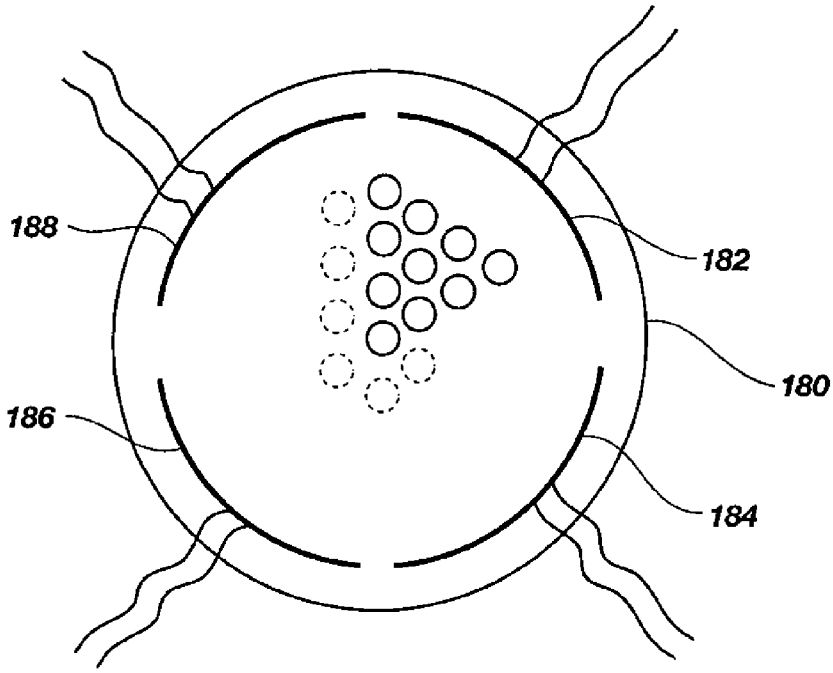
FIG. 18 is a top view of an emitter face with four electrical contacts.

FIG. 18 shows an emitter face 170 with four electrical contacts 182, 184, 186, 188. Although only four contacts are shown, the number of contacts is only limited by the size and number of regions that are desired to be controlled. The more electrical contacts which are manufactured on the emitter face, the greater the control of the separate piezoelectric regions. Each separate cell may even have its own electrical contacts. It should also be realized that a nearly unlimited number of contact arrangements are possible based on conventional electrode sputtering or flowing techniques.

Figure 19:
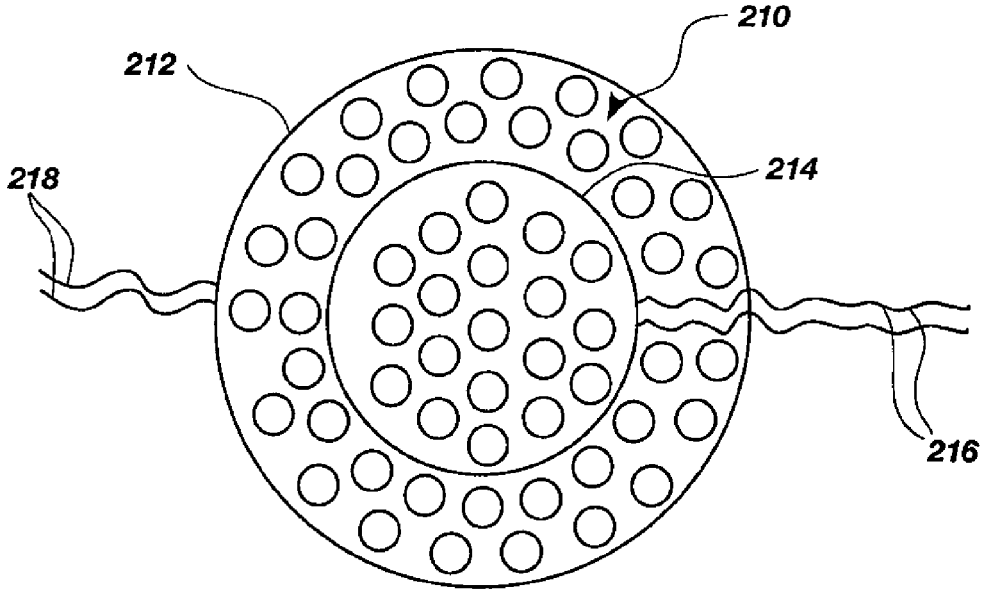
FIG. 19 is a top view of an emitter face with two concentric electrical contact rings.
Figure 20:
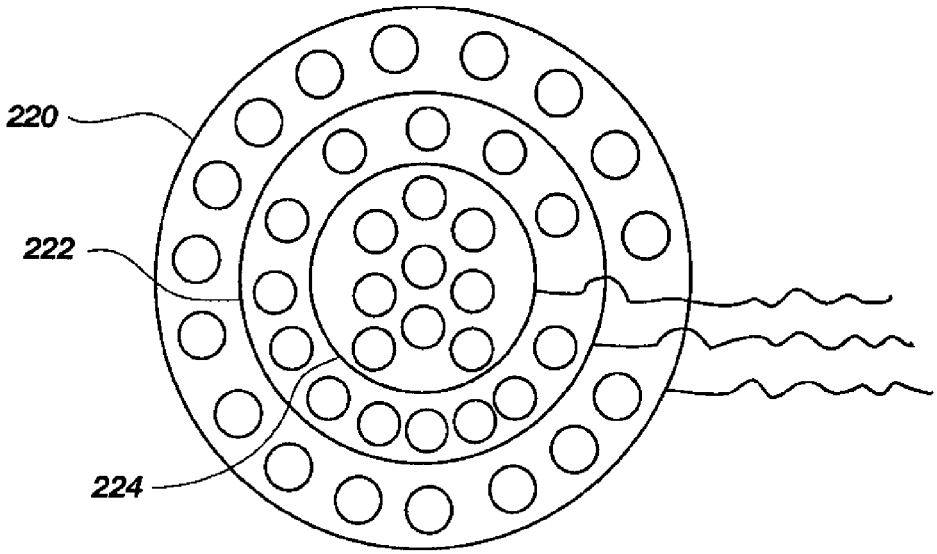
FIG. 20 is a top view of an emitter face with three concentric electrical contact rings.

Two other important embodiments using spatially arranged electrical contacts on piezoelectric film are shown in FIGS. 19 and 20. FIG. 19 shows a piezoelectric film 210 with two concentric electrical contact rings 212, 214. In the preferred implementation, the center ring 214 would contain approximately ½ of the total circle area and the second electrical contact would circumscribe the whole circle 214. The two electrical rings can each receive separate electrical signals from the wires 218 and 216. The signals may be phase shifted to create beam steering or spatial sound orientation. In addition, a separate channel can be used for each electrode. For example, one channel can be sent to the central ring such as a voice channel, and then a second channel can be sent to the second ring such as environmental background sounds. Essentially, the voice channel and the background channel in this example are spatially mixed on the piezoelectric film. FIG. 20 shows an alternative arrangement of an electrical contact embodiment with three electrical contacts 220, 222, 224. Additional contacts increase the control that can be exerted on the piezoelectric film.

Figure 28:
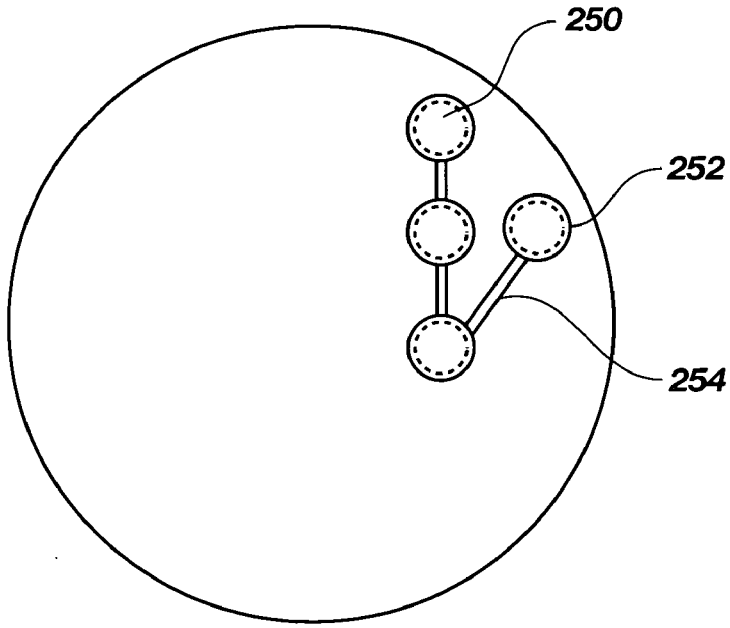
FIG. 28 shows selective sputtering over the face plate apertures, which are connected by metalized bridge contacts.

The conventional method for manufacturing piezoelectric film is to sputter the entire film with a metallic coating. The drawback to using a metallic coating over the whole surface of the piezoelectric film is that when the voltage is applied, some areas of the film are driven which should not move or cannot readily move. For example, some parts of the film may be under a clamp, under a bolt, or otherwise attached to the emitter face. When areas are driven that cannot move, unwanted heat is created. The present invention solves this problem by only sputtering or applying the metallic coating to areas where it is necessary. Areas that should not be driven and which are fastened or clamped in place will not be metalized. Referring now to FIG. 28, the figure shows that the piezoelectric film will be selectively sputtered 252 to match the apertures 250 of the emitter face and areas where the film should not move will be avoided. Of course, each metalized area must be connected electrically to other metalized areas and this is done by using metalized bridge contacts 254 where necessary.

Another problem is that metallic areas under a bolt or near a contact area may cause arcing. Selective sputtering can be applied to the perimeter of the film in a pattern which avoids arcing with any electrically conductive housing components. Metalizing only the active areas also decreases the capacitance that the amplifier is required to drive. The selective sputtering can be effectively applied using well known mask techniques.

Figure 21:
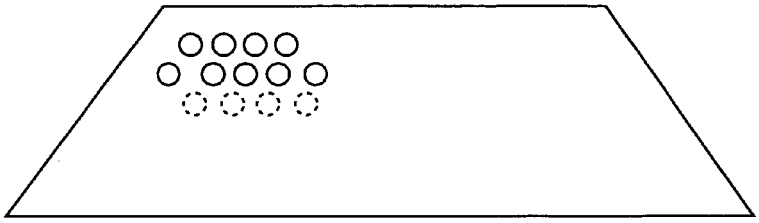
FIG. 21 shows polygon shaped sections for piezoelectric film with a polygon shaped emitter face beneath the film.
Figure 22:
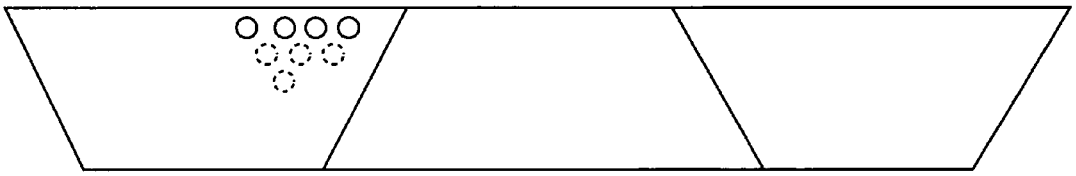
FIG. 22 shows three polygon shaped sections of piezoelectric film with a corresponding emitter face beneath the film.

FIG. 21 shows a polygon shaped piece of piezoelectric film attached to an emitter plate. The polygon shaped piece of film is easier to manufacture and tool than a large circular piece of film. Another advantage obtained by using smaller geometric shapes is that many of them can be combined together to produce a large emitter face which reduces the problems found in creating one large emitter diaphragm (e.g., tensioning problems). FIG. 22 shows three polygon shaped pieces of film joined together to form one long emitter face. It should be apparent that any smaller regular geometric shape could be selected, and then tessellated to form a larger emitter surface.

Figure 23:
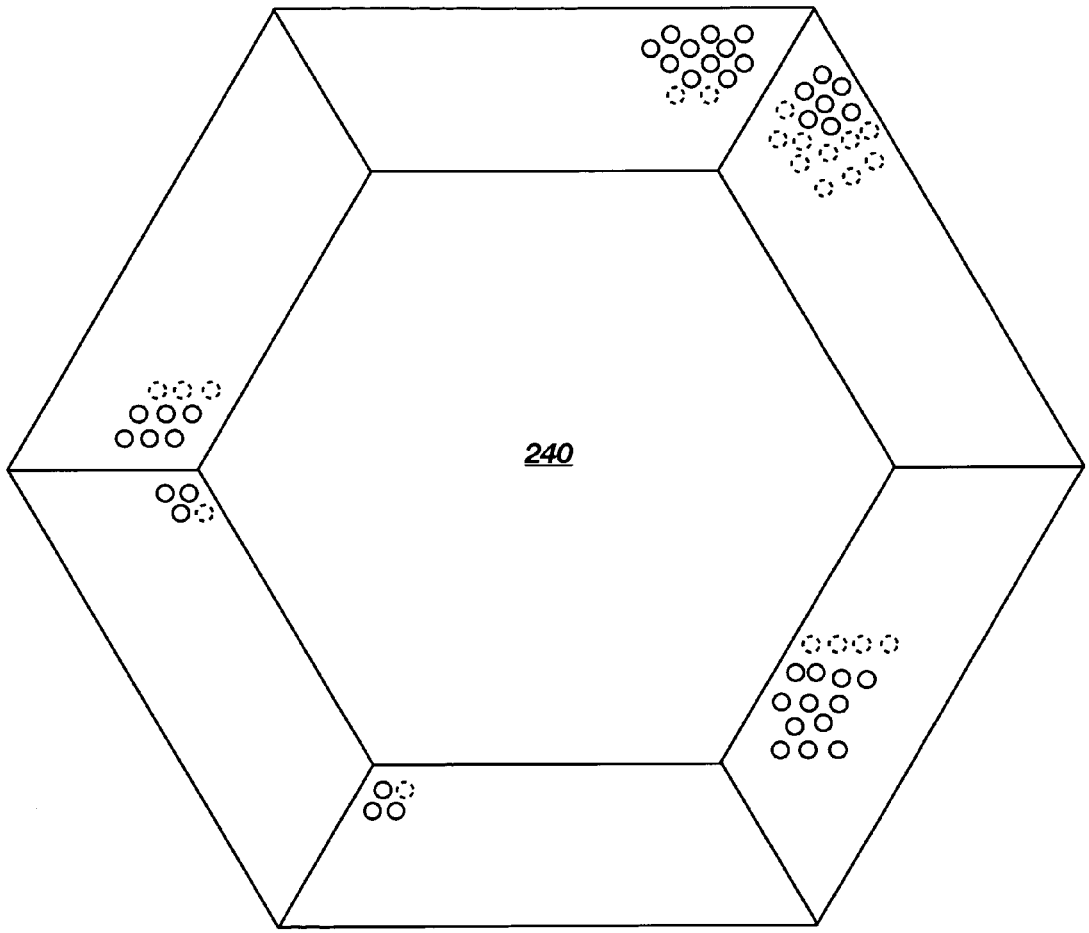
FIG. 23 shows six polygon shaped sections of piezoelectric film in a hexagonal shape, forming a ring configuration.

FIG. 23 shows six polygon shaped pieces of piezoelectric film joined together in a hexagonal ring to produce an emitter. The center of the ring 240 is not an active emitter area and can be either empty space or some other non-piezoelectric material. The surprising result of the configuration shown in FIG. 23 is that it can produce 80% to 90% as much output as a hexagon speaker which has an active center area. The configuration shown in FIG. 23 has only 50% of the piezoelectric film area as compared to a hexagon with an active center area, but there is with only a 10% to 20% decrease in output.

Figure 24:
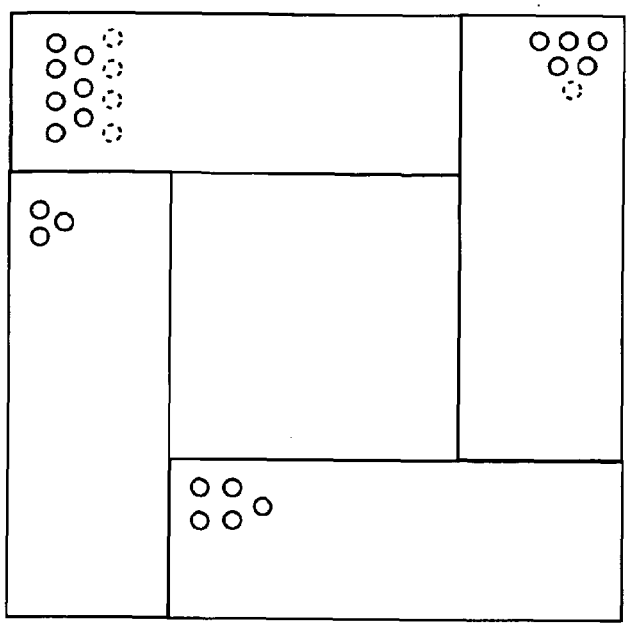
FIG. 24 is four rectangular shaped sections of piezoelectric film in a box shape.
Figure 25:
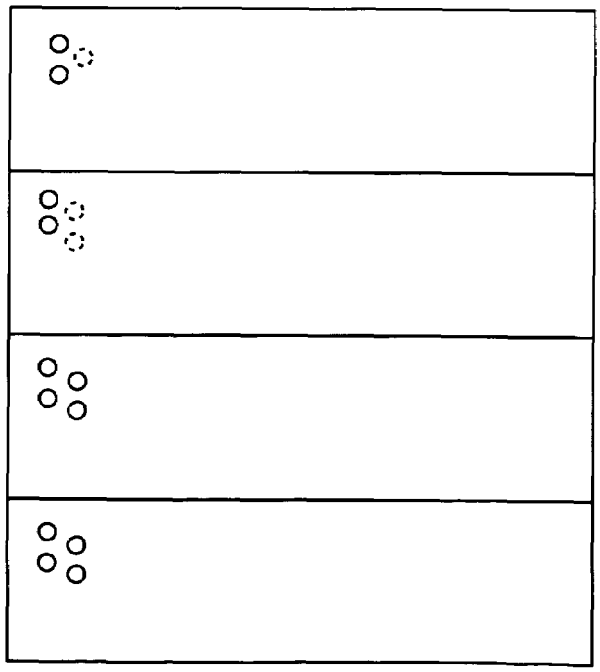
FIG. 25 is four rectangular shaped sections of piezoelectric film in a column.

FIGS. 24 and 25 show two embodiments of the invention using as smaller rectangular piezoelectric film sections to form larger emitter shapes. FIG. 24 shows four rectangular sections combined together in a square shape with an open center. This configuration has the same advantages as described for the hexagonal ring. FIG. 24 shows four rectangular section combined in a column. It is also desirable to use more or even fewer piezoelectric film sections and combine them together in geometric arrangements to produce greater output.

Figure 26:
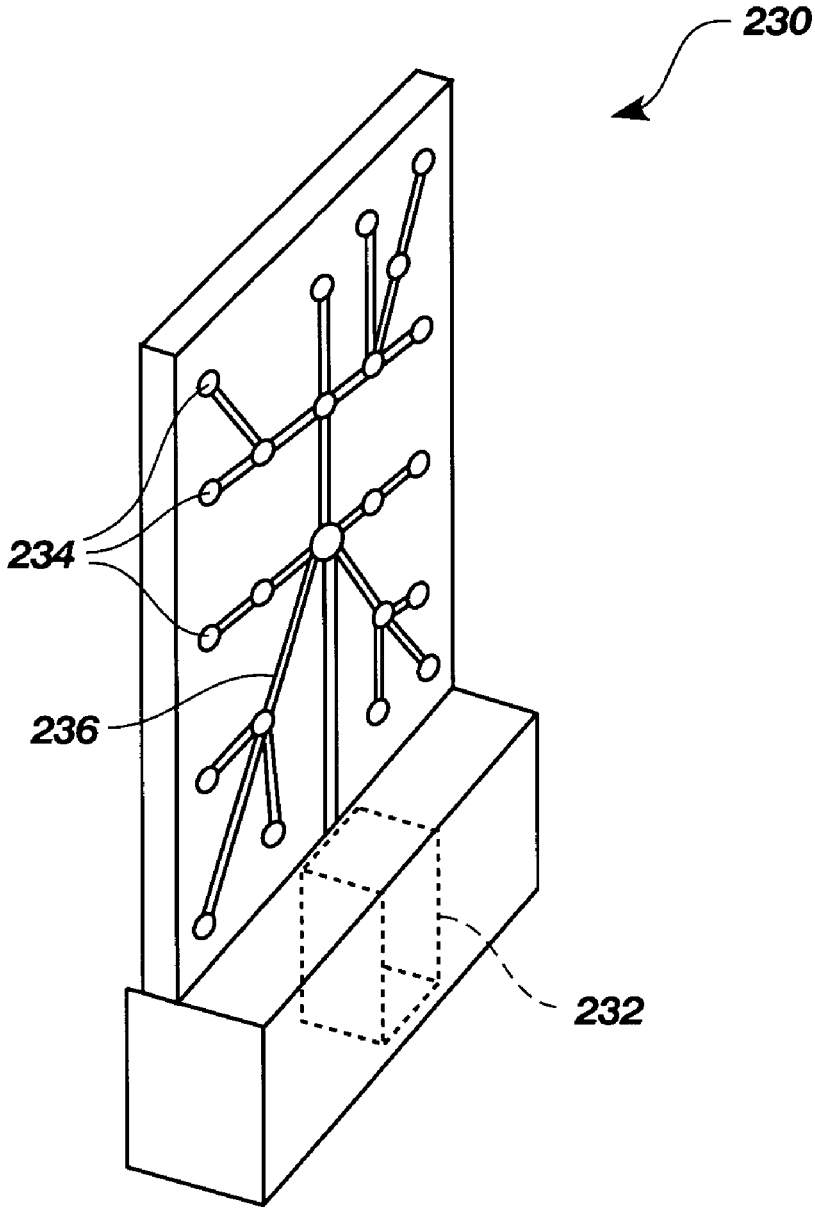
FIG. 26 is a pressurized chamber which is connected with a number of piezoelectric film emitter cells.

FIG. 26 shows a piezoelectric film emitter 230 with a small pressure chamber 232 which is remote from a number of piezoelectric film cells 234. The pressure chamber 232 is equivalent to a single plenum chamber and is connected to the piezoelectric film cells 234 by thin pressure tubes 236. The pressurized tubes 236 transfer pressure from the pressure chamber 232 to form the piezoelectric film on each cell 234 into arcuate emitter shapes. Each piezoelectric film cell must have enough pressure to form the piezoelectric film into its arcuate shape. The benefit of using the pressure chamber 232 with tubes 236 is that a pressure gradient loss along the thin tubes is avoided. Because the collective area of the tubes 236 is relatively small, the use of the tubes does not decrease the pressure but distributes it to each of the respective emitter cells 234. In addition, the size of the pressure chamber 232 is also relatively small because the small volume in the tubes only requires a small pressure chamber source. Alternatively, the interconnected tubes could be pressurized directly without a pressure chamber or a specific source. In addition, the number and arrangement of the piezoelectric film cells 234 and tubes 236 is limited only by practical constraints.

Figure 27:
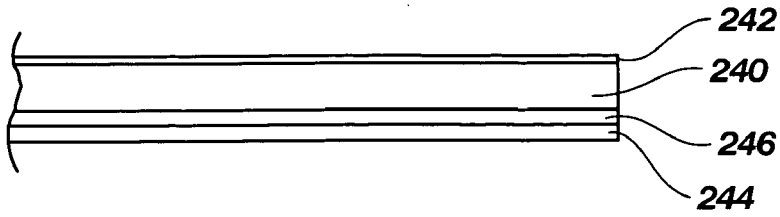
FIG. 27 shows piezoelectric film sealed with PVDC.

A more detailed description of the sealant coating as shown in FIGS. 3*c* and 3*d* will now be covered, and a method for sealing the piezoelectric film will also be discussed. Referring now to FIG. 27, the structure of sealed piezoelectric film is shown. The center layer is the piezoelectric film 240. The film is typically a PVDF film or a similar piezoelectric copolymer. A sealing material 246 is applied to the PVDF. The sealing material is PVDC (polyvinylidene chloride) which has high gas barrier properties. The PVDC may be applied to the piezoelectric film by brushing, air brushing, or dipping the PVDF in a bath of PVDC. In addition, the PVDC may be applied to the piezoelectric film before or after the film is electrically charged. The PVDC bonds into the structure of the piezoelectric film and provides an effective barrier which stops gasses from passing through the film 240. After the PVDC has been applied to the piezoelectric film, electrodes 242 and 244 are sputtered or evaporated onto the film 240. The sealing material (PVDC) may also be applied after the electrodes have been applied to the film.

It should also be apparent from the description above that the preferred and alternative embodiments can emit sonic frequencies directly, without having to resort to the acoustical heterodyning process described earlier. However, the range of frequencies in the audible spectrum is necessarily limited to generally higher frequencies, as the invention is most effective in the mid-range and upper frequencies. Therefore, the greatest advantages of the present invention are realized when the invention is used to generate the entire range of audible frequencies indirectly using acoustical heterodyning as explained above.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A speaker device for emitting subsonic, sonic or ultrasonic compression waves, said device being comprised of:

a rigid emitter plate having an outer face oriented outward and an inner face, said emitter plate having a plurality of apertures extending between the outer and inner faces;

a thin piezoelectric film disposed across the apertures of the emitter plate, wherein the thin piezoelectric film is configured to be distended into an arcuate emitter configuration at each of the plurality of apertures;

electrical contact means coupled to the piezoelectric film for providing an applied electrical input; and pressure means coupled to the emitter plate for developing a biasing pressure with respect to the thin film at the apertures to distend the film at each of the plurality of apertures into an arcuate emitter configuration capable of constricting and extending in response to variations in the applied electrical input at the piezoelectric film to thereby create a compression wave in a surrounding environment.

2. The speaker device as in claim 1 further comprising a thin polymer coating on the piezoelectric film, wherein the thin polymer coating seals the piezoelectric film and prevents pressure leakage.

3. The speaker device as in claim 2 wherein the thin polymer coating is polyvinylidelene chloride.

4. The speaker device as in claim 1 further comprising a heavy inert gas in the pressure means, wherein the heavy inert gas reduces gas leakage through the piezoelectric film.

5. The speaker device as in claim 4 wherein the heavy inert gas is nitrogen.

6. The speaker device as in claim 1 wherein the apertures have a center and the apertures are spaced apart ¼ to ½ of a wavelength of a selected frequency from aperture center to aperture center.

7. The speaker device as in claim 1 wherein the rigid emitter plate is convex to disperse wave output.

8. The speaker device as in claim 1 wherein the rigid emitter plate is concave to focus wave output.

9. The speaker device as in claim 1 wherein the apertures are between 0.050 and 0.600 inches in diameter.

10. The speaker device as in claim 1 wherein the biasing pressure in the pressure means is between approximately 0 and 20 pounds per square inch.

11. The speaker device as in claim 1 further comprising a pressure seal around a perimeter of the piezoelectric film, wherein the pressure seal is used as the electrical contact means to drive the piezoelectric film.

12. The speaker device as in claim 1 wherein the piezoelectric film thickness is approximately 9 microns, aperture diameter is approximately 0.160 inches, and the biasing pressure is approximately 5 pounds per square inch, wherein a resonant frequency of approximately 35 kHz is produced.

13. The speaker device as in claim 1 wherein the piezoelectric film thickness is approximately 12 microns, aperture diameter is approximately 0.168 inches, and the biasing pressure is approximately 6 pounds per square inch, wherein a resonant frequency of approximately 35 kHz is produced.

14. The speaker device as in claim 1 wherein the piezoelectric film thickness is less than 25 microns, aperture diameter is less than 0.200 inches and the biasing pressure is less than 12 pounds per square inch, wherein a resonant frequency of approximately 35 kHz to 60 kHz is produced.

15. The speaker device as in claim 1 further comprising a clamping member to clamp the piezoelectric film to the rigid emitter plate, wherein the clamping member has a plurality of clamping apertures which correspond to the plurality of apertures in the emitter face.

16. The speaker device as in claim 1 further comprising a generally hollow drum having a sidewall and a first and second opposing means, wherein the rigid emitter plate is attached to the first end of the drum and the inner face is disposed toward an interior cavity of the drum.

17. The speaker device as in claim 16 wherein the pressure means is coupled to the drum for developing a positive biasing pressure with respect to the thin film at the apertures.

18. The speaker device as in claim 1, further comprising:

an ultrasonic frequency generating means for supplying an ultrasonic signal to the piezoelectric film;

a sonic frequency generating means for supplying a sonic signal which is to be modulated onto the ultrasonic signal;

modulating means coupled to the ultrasonic frequency generating means and the sonic frequency generating means to develop an ultrasonic carrier wave with modulated sonic wave; and transmission means coupled to the modulating means for supplying the carrier wave and modulated sonic wave to the piezoelectric film for stimulating generation of corresponding compression waves at the emitter plate.

19. A speaker device for emitting subsonic, sonic or ultrasonic compression waves, said device being comprised of:

a rigid emitter plate having an outer face oriented outward and an inner face, said emitter plate having a plurality of apertures extending between the outer and inner faces;

a thin piezoelectric film disposed across the apertures of the emitter plate, wherein the thin piezoelectric film is configured to be distended into an arcuate emitter configuration at each of the plurality of apertures;

electrical contact means coupled to the piezoelectric film for providing an applied electrical input; and pressure means coupled to the rigid emitter plate for developing a positive biasing pressure with respect to the thin film at the apertures to distend the film at each of the plurality of apertures into an arcuate emitter configuration capable of constricting and extending in response to variations in the applied electrical input at the piezoelectric film to thereby create a compression wave in a surrounding environment.

20. A speaker device as in claim 19 wherein the thin piezoelectric film is disposed on the inner face, under the apertures of the emitter plate.

21. The speaker device as in claim 19 further comprising a thin polymer coating on the piezoelectric film, wherein the thin polymer coating seals the piezoelectric film and prevents pressure leakage.

22. The speaker device as in claim 21 wherein the thin polymer coating is polyvinylidelene chloride (PVDC).

23. The speaker device as in claim 19 further comprising a heavy inert gas in the pressure means, wherein the heavy inert gas reduces gas leakage through the piezoelectric film.

24. The speaker device as in claim 23 wherein the heavy inert gas is nitrogen.

25. The speaker device as in claim 19 wherein the apertures have a center and the apertures are spaced apart ¼ to ½ of a wavelength of a selected frequency from aperture center to aperture center.

26. The speaker device as in claim 19 wherein the rigid emitter plate is convex to disperse wave output.

27. The speaker device as in claim 19 wherein the rigid emitter plate is concave to focus wave output.

28. The speaker device as in claim 19 wherein the apertures are between 0.050 and 0.600 inches in diameter.

29. The speaker device as in claim 19 wherein the positive biasing pressure in the pressure means is between approximately 0 and 20 pounds per square inch.

30. The speaker device as in claim 19 wherein the piezoelectric film thickness is approximately 9 microns, aperture diameter is approximately 0.160 inches, and the positive biasing pressure is approximately 5 pounds per square inch, wherein a resonant frequency of approximately 35 kHz is produced.

31. The speaker device as in claim 19 wherein the piezoelectric film thickness is approximately 12 microns, aperture diameter is approximately 0.168 inches, and the positive biasing pressure is approximately 6 pounds per square inch, wherein a resonant frequency of approximately 35 kHz is produced.

32. The speaker device as in claim 19 wherein the piezoelectric film thickness is less than 25 microns, aperture diameter is less than 0.600 inches and the biasing pressure is less than 12 pounds per square inch, wherein a resonant frequency of approximately 35 kHz to 60 kHz is produced.

33. The speaker device as in claim 19 further comprising a clamping member to clamp the piezoelectric film to the rigid emitter plate, wherein the clamping member has a plurality of clamping apertures which correspond to the plurality of apertures in the emitter face.

34. A speaker device as in claim 19 further comprising a wave reinforcement structure disposed inside the interior cavity of the drum, and spaced a distance from the piezoelectric film to enhance a selected frequency.

35. The speaker device as in claim 34 wherein the wave reinforcement structure is disposed at the second opposing end of the drum.

36. The speaker device as in claim 34 wherein the wave reinforcement structure is a distance from the piezoelectric film selected from the group of distances consisting of ¼, ½ and 1 wavelength of the selected frequency from the piezoelectric film.

37. The speaker device as in claim 34 wherein the wave reinforcement structure is a distance from the piezoelectric film selected from the group of distances consisting of ¼, ½ and 1 wavelength of the carrier frequency from the piezoelectric film.

38. The speaker device as in claim 34 wherein the wave reinforcement structure is ¼ of a wavelength of the carrier frequency from the piezoelectric film.

39. The speaker device as in claim 34 wherein the wave reinforcement structure is a distance from the piezoelectric film selected from the group of distances consisting of ¼, ½ and 1 wavelength of the resonant frequency from the piezoelectric film.

40. The speaker device as in claim 34 wherein the wave reinforcement structure is ¼ of a wavelength of the resonant frequency from the piezoelectric film.

41. The speaker device of claim 34 wherein the wave reinforcement structure is curved.

42. The speaker device as in claim 19, further comprising:

an ultrasonic frequency generating means for supplying an ultrasonic signal to the piezoelectric film;

a sonic frequency generating means for supplying a sonic signal which is to be modulated onto the ultrasonic signal;

modulating means coupled to the ultrasonic frequency generating means and the sonic frequency generating means to develop an ultrasonic carrier wave with modulated sonic wave; and transmission means coupled to the modulating means for supplying the carrier wave and modulated sonic wave to the piezoelectric film for stimulating generation of corresponding compression waves at the emitter plate.

* * * * *